US007289134B2

(12) United States Patent
Murayama et al.

(10) Patent No.: US 7,289,134 B2
(45) Date of Patent: Oct. 30, 2007

(54) THERMAL PRINTER INCLUDING A PLURALITY OF RECORDING UNITS

(75) Inventors: Hiroyuki Murayama, Fukushima-ken (JP); Hiroshi Takahashi, Fukushima-ken (JP); Koichi Sugiyama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 261 days.

(21) Appl. No.: 11/137,627

(22) Filed: May 25, 2005

(65) Prior Publication Data

US 2005/0264643 A1 Dec. 1, 2005

(30) Foreign Application Priority Data

May 27, 2004 (JP) ..... 2004-157560
Sep. 13, 2004 (JP) ..... 2004-265183
Jan. 31, 2005 (JP) ..... 2005-023797

(51) Int. Cl.
*B41J 2/32* (2006.01)
*B41J 2/325* (2006.01)
*B41J 15/16* (2006.01)

(52) U.S. Cl. ..... 347/173

(58) Field of Classification Search ..... 347/171, 347/172, 173; 400/120.01, 120.02, 120.04, 400/120.03

See application file for complete search history.

(56) References Cited

U.S. PATENT DOCUMENTS 5,711,620 A * 1/1998 Sasaki et al. ..... 400/120.02
5,721,621 A * 2/1998 Komaki et al. ..... 358/296
5,724,085 A 3/1998 Inui
5,847,742 A 12/1998 Nishimura
6,474,886 B1 11/2002 Sugiyama et al.
6,744,455 B2 6/2004 Coons et al.

FOREIGN PATENT DOCUMENTS

EP 1 036 662 A2 9/2000
EP 1 036 662 A3 1/2001
JP 08-174878 7/1996
JP 09-156142 6/1997
JP 09-169130 6/1997
JP 2001-246769 9/2001
JP 2003-231318 8/2003

OTHER PUBLICATIONS

Search Report dated Jun. 22, 2006, for corresponding European Patent Application No. 05011357.

* cited by examiner

*Primary Examiner*—Huan Tran
(74) *Attorney, Agent, or Firm*—Brinks Hofer Gilson & Lione

(57) ABSTRACT

To provide a thermal printer capable of easily improving a recording quality, a plurality of recording units, arranged along a carrying path of a recording medium, are respectively provided with a recording head, a platen which opposes the recording head with the carrying path interposed therebetween and is brought into contact with and separated from the recording head, a carrying unit including a carrying roller arranged on the downstream side of the recording head, and a friction unit including a friction roller arranged on the downstream side of the carrying unit in order to prevent the disturbance generated on the downstream side from propagating upstream via the recording medium, between the respective recording units.

11 Claims, 17 Drawing Sheets

THERMAL PRINTER INCLUDING A PLURALITY OF RECORDING UNITS

This application claims the benefit of priority to Japanese Patent Application Nos. 2004-157560 filed on May 27, 2004, 2004-265183 filed on Sep. 13, 2004, and 2005-023797 filed on Jan. 31, 2005, all herein incorporated by reference.

BACKGROUND OF THE INVENTION

1. Field of the Invention

The present invention relates to a thermal printer, and more specifically, to a thermal printer provided with a plurality of recording units along a carrying path of a long recording medium.

2. Description of the Related Art

Conventionally, a thermal printer is known, which records an image on a recording medium using a plurality of ink ribbons on which different colors of ink are coated respectively. In the thermal printer, a plurality of thermal heads provided corresponding to the respective ink ribbons transfers ink of the respective ink ribbons onto the recording medium to record a desired image on the recording medium. Such a thermal printer has a plurality of ink ribbons, on which multiple colors (for example, cyan (C), magenta (M), and yellow (Y)) of ink and transparent overcoat (OP) ink are respectively coated, and a plurality of thermal heads corresponding to the number of the ink ribbons. These thermal heads are arranged at predetermined intervals along a carrying path of the recording medium, each of the thermal heads being disposed to oppose the recording medium with the ink ribbon interposed therebetween. At a position opposite to each of the thermal heads, a platen is provided with the ink ribbon and the recording medium interposed therebetween.

In the thermal printer, a first thermal head, a second thermal head, a third thermal head, and a fourth thermal head are disposed in the above-mentioned order from the most upstream side in the carrying direction of the recording medium. If a recording-starting position of the recording medium reaches a position opposite to the first thermal head, the first thermal head is pressed against a first platen opposing the first thermal head. Specifically, the first thermal head is made to be down toward the first platen opposing the first thermal head or the first platen is made to be down toward the first thermal head. Then, the first thermal head is pressed against the first platen with the recording medium and the ink ribbon interposed therebetween, so that ink (C), for example, is transferred onto the recording medium by the first thermal head.

Subsequently, if the recording-starting position of the recording medium reaches the position opposite to the second thermal head, the second thermal head is made to be down or the second platen opposing the second thermal head is made to be down. Then, the second thermal head is pressed against the second platen with the recording medium and the ink ribbon interposed therebetween, so that ink (M) is transferred by the second thermal head.

As such, the thermal heads are made to be down sequentially from the upstream thermal heads in the carrying path of the recording medium or the platen are made to be down sequentially from the upstream platen to transfer ink onto the recording medium. Then, a desired color image is recorded on the recording medium with a plurality of colors of ink (for example, refer to Patent Document 1).

A printer as a conventional thermal printer provided with a front tension roller on the downstream side of each of multiple thermal heads is proposed (for example, refer to Patent Document 2).

A printer as a conventional thermal printer is proposed, of which a carrying path is bent in each position of a capstan roller and a plurality of thermal heads so as to project into a pinch roller and a platen (for example, refer to Patent Document 3).

A printer as a conventional thermal printer is proposed, in which the slack is formed between a plurality of thermal heads (for example, refer to Patent Document 4).

[Patent Document 1] U.S. Pat. No. 6,474,886

[Patent Document 2] Japanese Unexamined Patent Application Publication No. 2003-231318

[Patent Document 3] Japanese Unexamined Patent Application Publication No. 2001-246769

[Patent Document 4] Japanese Unexamined Patent Application Publication No. 09-156142

However, in the conventional thermal printers, there is a problem in that they cannot meet the needs of high performance with the improvement of recording quality for recent years.

For example, if the second thermal head is pressed against the platen with the recording medium interposed therebetween on recording on the recording medium by the first thermal head, deviation in recording of the first thermal head occurs due to the impact onto the recording medium which is caused by the pressing operation.

In other words, in the conventional printers, disturbances generated on the downstream side between the respective thermal heads propagate through the recording medium toward the upstream side, which results in deteriorated recording quality.

SUMMARY OF THE INVENTION

The present invention has been made in view of the drawbacks inherent in the conventional thermal printers, and it is an object of the present invention to provide a thermal printer capable of easily improving recording quality.

In order to achieve the above-described object, a thermal printer according to the present invention includes a plurality of recording units arranged at predetermined intervals along a carrying path of a recording medium. Each of the recording units includes a thermal head, a platen opposing the thermal head with the carrying path interposed therebetween and provided so as to be brought into contact with and separated from the thermal head, a carrying roller arranged on the downstream side of the thermal head so as to carry the recording medium which passes through the thermal head toward the downstream side, a carrying and pressing roller that can be pressed against the carrying roller, a friction roller arranged on the downstream side of the carrying means so as to prevent disturbance generated downstream between the respective recording units from propagating upstream via the recording medium, and a friction pressing roller which can be pressed against the friction roller.

In the thermal printer according to this invention to achieve the above-described object, the recording medium is pressed by the friction roller and the friction pressing roller so that a friction load can be applied to the recording medium.

In order to achieve the above-described object, the thermal printer according to this invention further includes a friction-pressing-roller driving member supporting the friction pressing roller so that the friction pressing roller can be pressed against the friction roller.

In the thermal printer according to this invention to achieve the above-described object, the friction-pressing-roller driving member drives the friction pressing roller to be pressed against the friction roller when a leading end of the recording medium passes a position where the friction roller opposes the friction pressing roller.

In the thermal printer according to this invention to achieve the above-described object, the friction roller is formed so as to switch a fixed state where the friction roller is restricted from rotating about the carrying roller when the recording medium is introduced, to a free state where the friction roller can rotate about the carrying roller after forming a carrying path into the down stream recording unit.

In order to achieve the above-described object, the thermal printer according to this invention further includes an interlocking means that interlocks a pressing operation of the carrying and pressing roller against the carrying roller, a pressing operation of the friction pressing roller against the friction roller, and a switching operation of switching over from the fixed state to the free state for the friction roller, in the above-mentioned order.

In the thermal printer according to this invention to achieve the above-described object, the respective recording units, positioned adjacent to each other, are arranged at shorter intervals than the length of the recording region per one sheet for an image to be recorded on the recording medium.

In the thermal printer according to this invention to achieve the above-described object, the carrying path, which connects the line thermal head and the carrying roller, in a recording state, of the downstream recording unit of a pair of adjacent recording units is disposed at a position shifted from the extended direction of the carrying path connecting the carrying roller and the line thermal head of the upstream recording unit in a recording state is formed to establish the carrying path into the downstream recording unit of the pair of adjacent recording units, by the friction roller and the friction pressing roller.

In order to achieve the above-described object, the thermal printer according to this invention further includes a control section for controlling nip portions of the friction pressing roller and the friction roller, and the carrying means so that the recording medium, which is positioned in the carrying path between the thermal head and the platen roller of the recording unit arranged right downstream of the nip portions, has slack.

In order to achieve the above-described object, the thermal printer according to this invention further includes a determination sensor that determines whether the amount of slack of the recording medium is within an appropriate range or not.

In the thermal printer according to this invention to achieve the above-described object, in the case in which the determination sensor determined that the amount of slack is not within an appropriate range, the control section controls the carrying speed of the recording medium carried by the carrying means of the upstream recording unit so that the amount of slack falls within an appropriate range.

According to the thermal printer of this invention, the friction roller and the friction pressing roller can prevent the disturbance generated on the downstream side from propagating upstream via the recording medium, so that an excellent advantage is achieved, for example, recording quality is can be easily improved.

DETAILED DESCRIPTION OF THE PREFERRED EMBODIMENT

Hereinafter, a first embodiment of the present invention will now be described with reference to the drawings.

Figure 1:
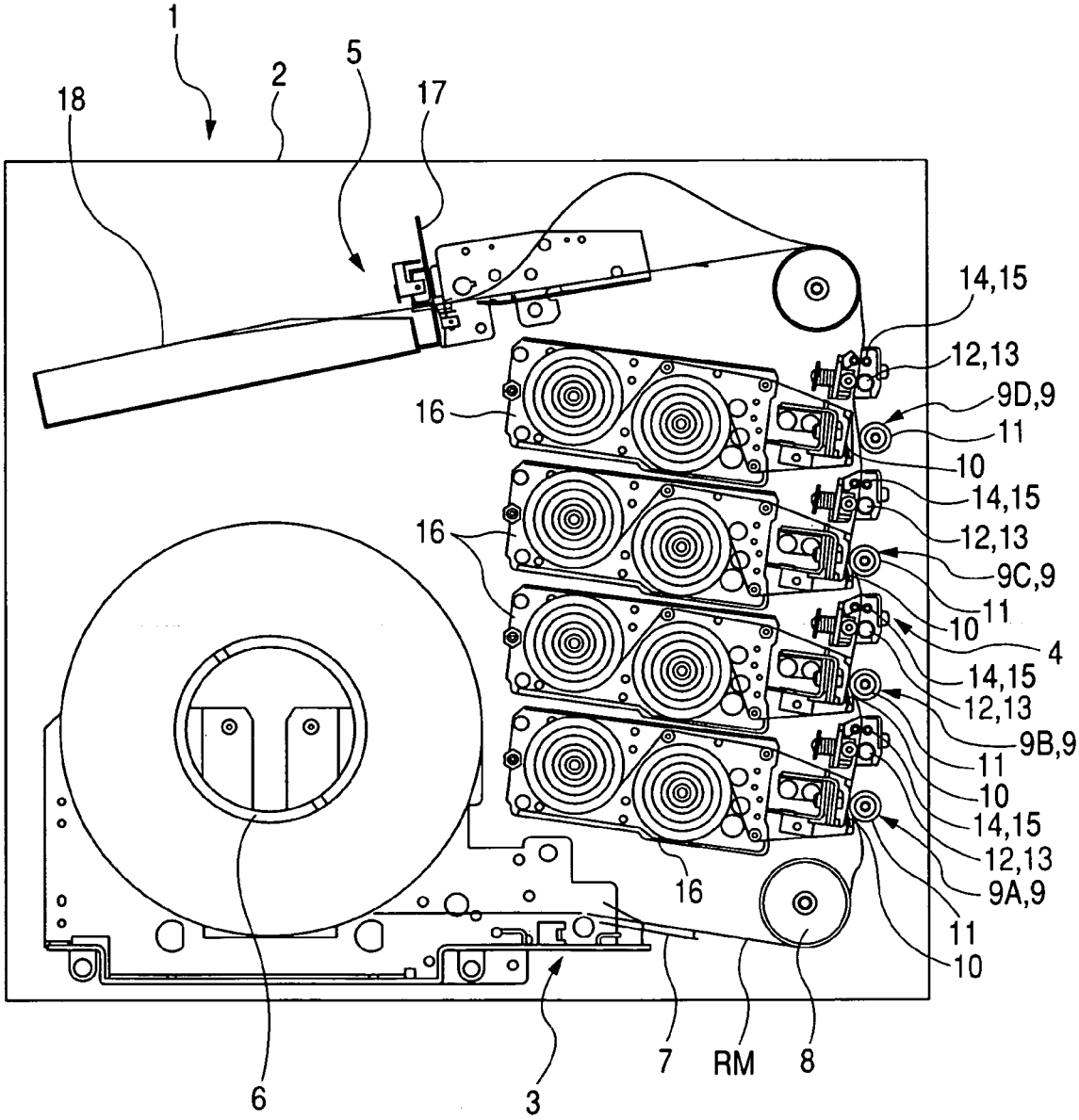
FIG. 1 is a simplified schematic view illustrating essential parts of an entire configuration in a recording state of a thermal printer according to a preferred embodiment of the present invention.
Figure 2:
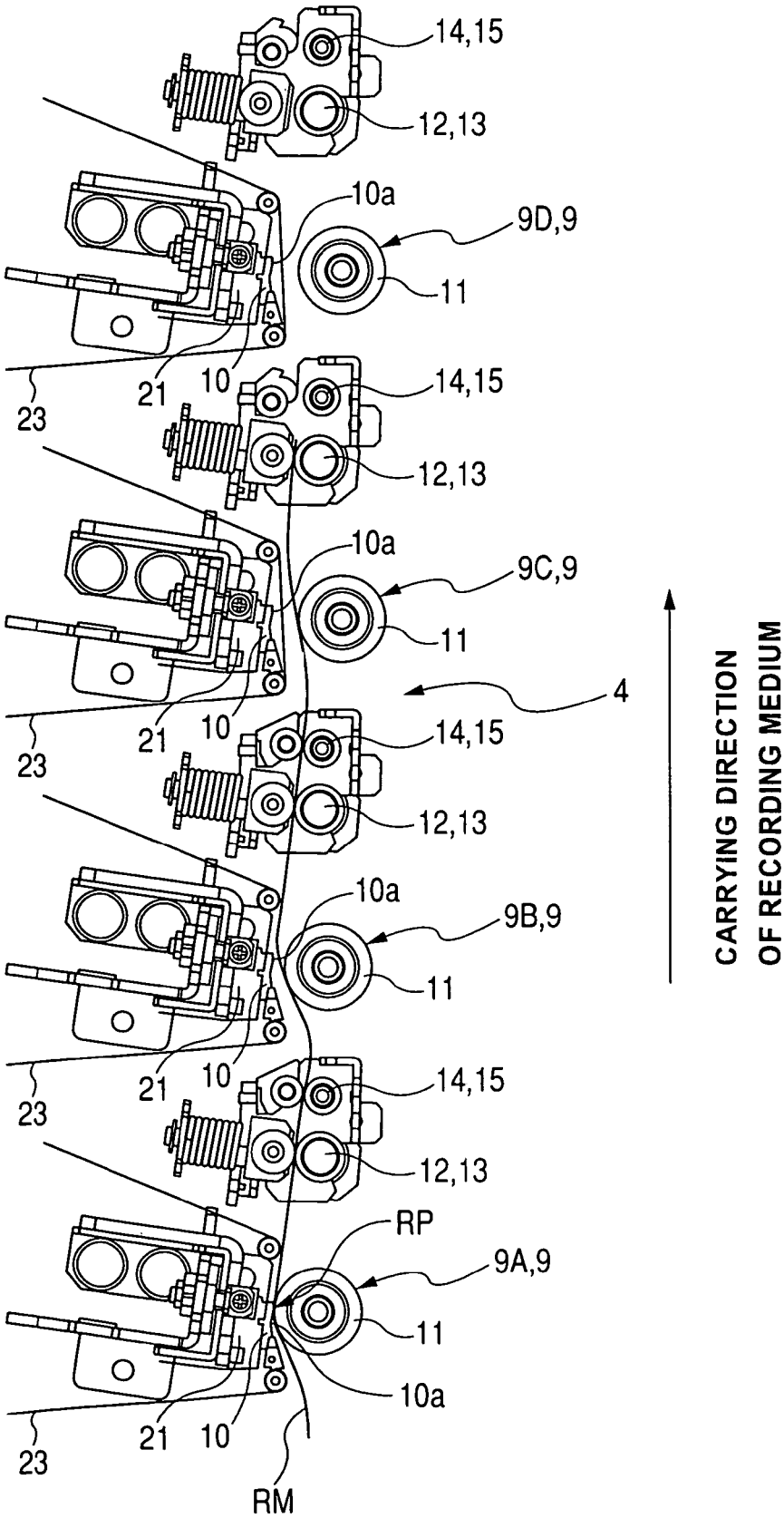
FIG. 2 is an enlarged schematic view illustrating the essential parts of a recording section in a state where a recording medium is introduced into a third recording unit.

FIG. 1 and FIG. 2 show a thermal printer according to a preferred embodiment of the present invention, in which FIG. 1 is a simplified schematic view illustrating essential parts of an entire configuration and FIG. 2 is an enlarged schematic view illustrating essential parts of a recording section.

As shown in FIG. 1, a thermal printer 1 of the present invention has a supply section 3 of recording medium RM arranged nearly horizontally along the left-right direction in the lower portion of FIG. 1, a recording section 4 arranged nearly vertically along the up and down directions in the right portion of FIG. 1, a discharge section 5 of recording medium RM arranged nearly horizontally along the left and right directions in the upper portion of FIG. 1, inside a thermal-printer main body 2. In other words, the supply section 3, the recording section 4, and the discharge section 5 as a whole are arranged in a U-shape and a carrying path of a recording medium RM as a whole are formed in a U-shape.

The supply section 3 is provided for holding the long recording medium RM to be supplied to the recording section 4. A supply roller 6 with the recording medium RM wound is detachably mounted to the supply section 3. Further, the recording medium RM is fed out from the supply roller 6 by a driving force of a supplying roller (not shown) to be carried to the recording section 4 while guided along a predetermined carrying path by a supplying guide means such as a guide plate 7 and a guide roller 8.

In the recording section 4 for recording a desired image on the recording medium RM, four recording units 9 for performing full-color recording in the present embodiment are arranged along the carrying direction (upward from the lower side of FIG. 1 in the recording section 4 as a whole) of the recording medium RM. These recording units 9 are constituted by a first recording unit 9A, a second recording unit 9B, a third recording unit 9C, and a fourth recording unit 9D, which are arranged in the above-mentioned order from the most upstream side of the carrying direction of the recording medium RM shown in the lower portion of FIG. 1 to the downstream side shown in the upper portion of FIG. 1.

Moreover, each of the recording units 9 arranged in the recording section 4 has a line thermal head 10 as a thermal head, a platen roller 11 as a platen, a carrying means 13 having a carrying roller 12, a friction means 15 having a friction roller 14, and a ribbon cassette 16, as shown in FIGS. 1 and 2.

As shown in FIG. 1, between a pair of adjacent recording units 9, the carrying path connecting the line thermal head 10 and the carrying roller 12 of the recording unit 9 positioned downstream in a recording state is disposed at a position shifted from the extended direction of the carrying path connecting the carrying roller 12 and the line thermal head 10 of the upstream recording unit 9 in a recording state, and in the present embodiment, is disposed at a position shifted to the left in FIG. 1. Meanwhile, the carrying path connecting the carrying roller 12 and the line thermal head 10 of the upstream recording unit 9 in a recording state is the carrying path connecting the line thermal head 10 and the surface of the carrying roller 12 opposing the recording medium RM.

In other words, the carrying path connecting the line thermal head 10 and the carrying roller 12 in a recording state of the recording unit 9 of the present embodiment is formed in a downward-stair shape as a whole.

Accordingly, when the recording medium RM is supplied from the upstream recording unit 9 to the downstream recording unit 9, the recording medium RM can be loosened (curved).

In addition, between a pair of adjacent recording units 9, the friction roller 14 can establish a carrying path into the downstream recording unit 9 when the recording medium is introduced. Moreover, each of the recording units 9 has the same configuration and the adjacent recording units 9 are arranged with a distance shorter than a longitudinal length of the image-recorded region for an image plane to be recorded on the recording medium RM.

A job of the discharge section 5 is to cut a recording medium RM, on which an image has been recorded by the recording section 4, into a predetermined length and to further accommodate and hold the recording medium RM. The discharge section 5 has a cutting means 17 having a cutting blade for cutting the long recording medium RM in the widthwise direction orthogonal to the longitudinal direction and a tray 18 for accommodating the cut recording medium RM, as shown in FIG. 1. The recording medium RM discharged from the recording section 4 is guided along a predetermined carrying path by a driving force of a discharging roller (not shown), and is then cut into a predetermined length by the cutting means 17 to be sequentially accommodated in the tray 18.

Hereinafter, a configuration of the respective recording units 9 will be described with reference to FIGS. 3 to 9.

Figure 3:
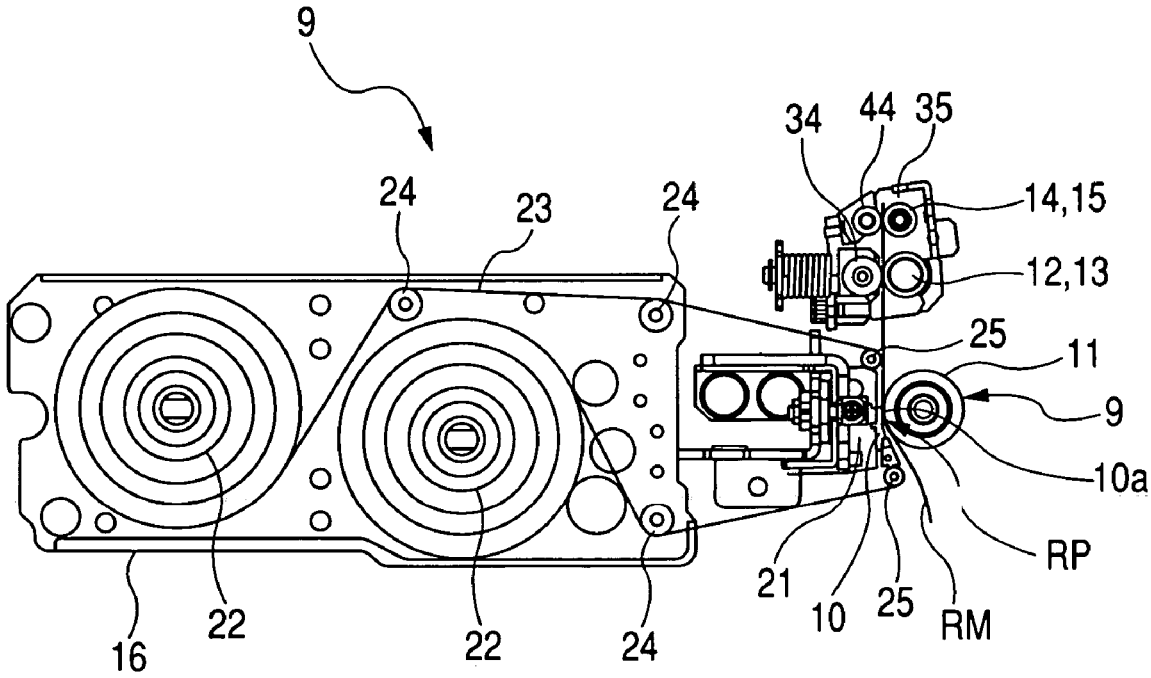
FIG. 3 is an enlarged schematic view illustrating the essential parts of a recording unit in a recording state.
Figure 4:
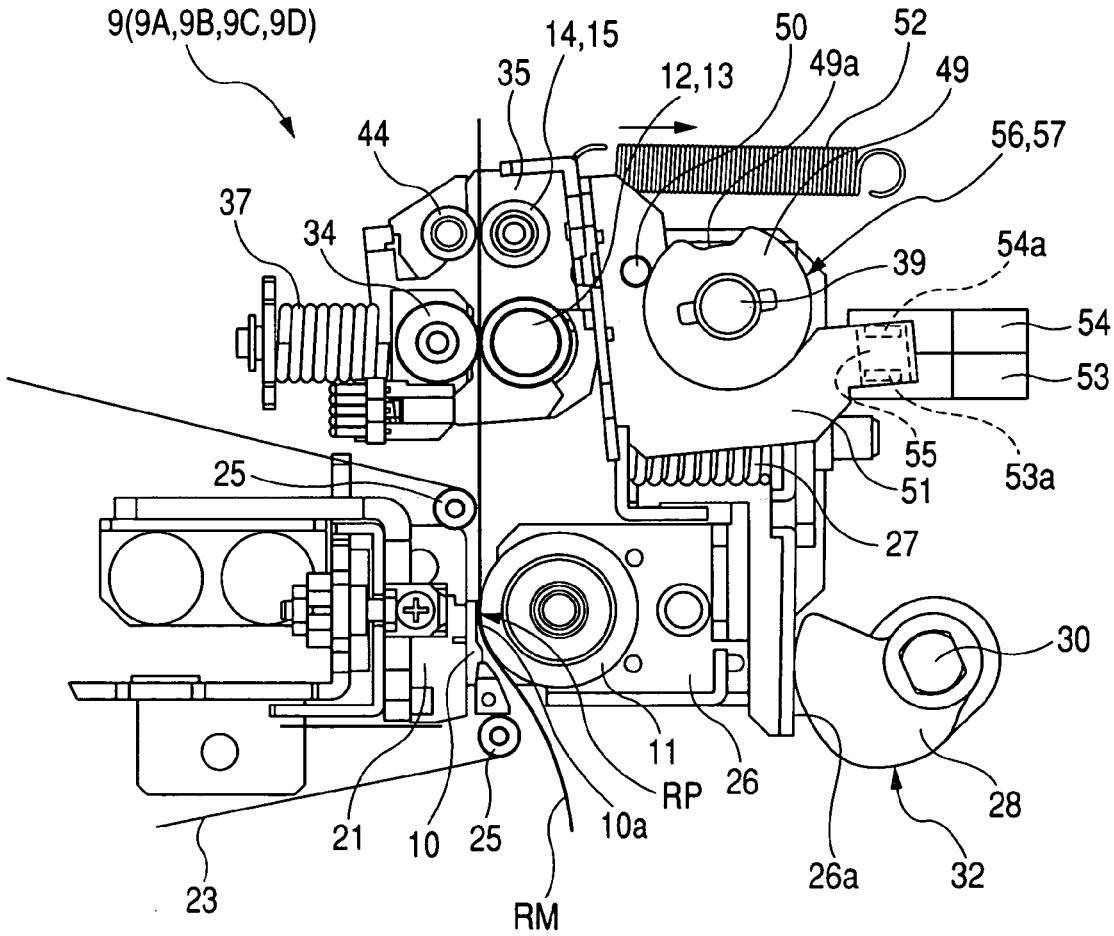
FIG. 4 is an enlarged schematic view illustrating the essential parts in the vicinity of a thermal head in a recording state of the recording unit.
Figure 5:
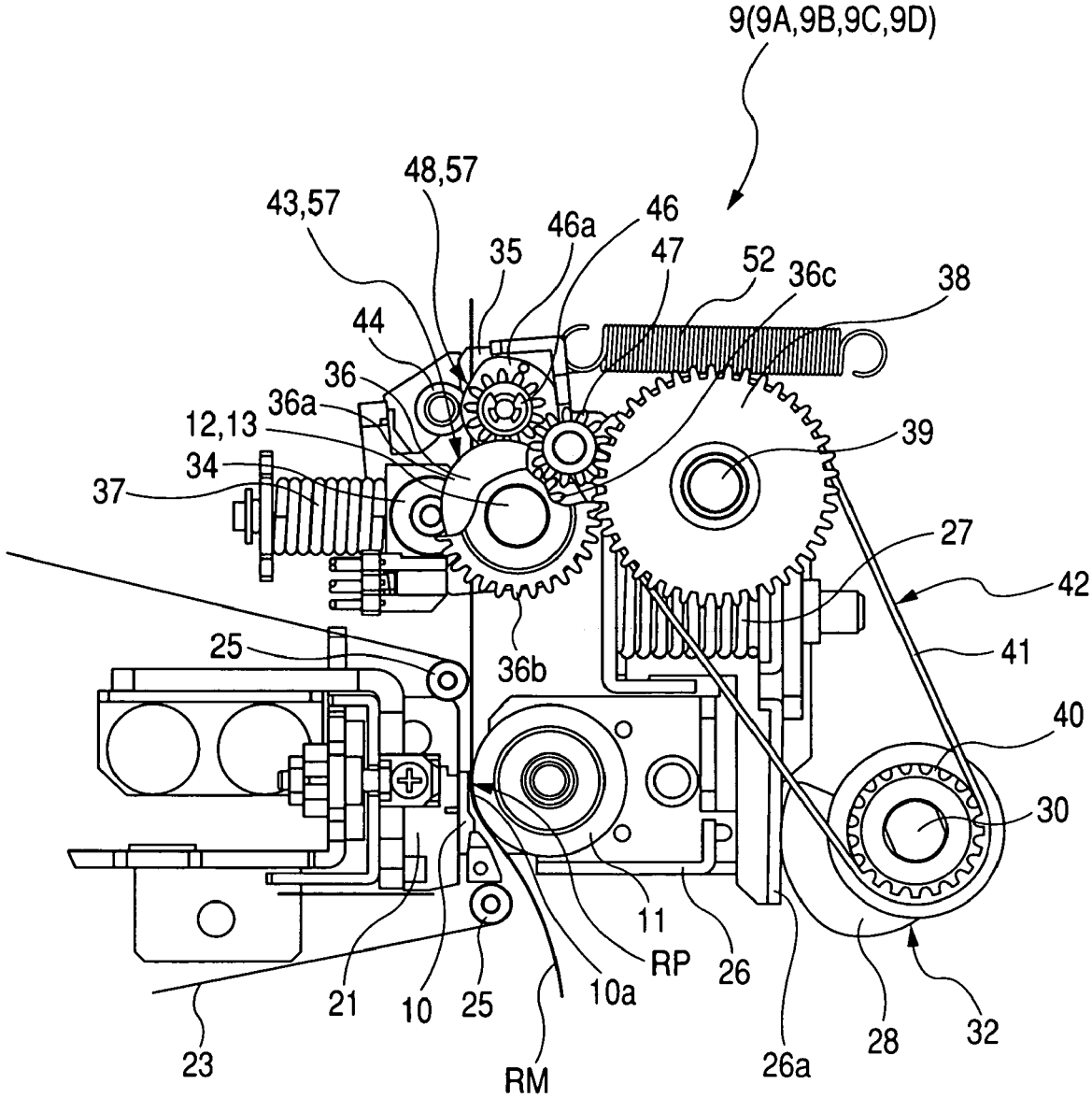
FIG. 5 is an enlarged schematic view illustrating the essential parts in the vicinity of an interlocking means in a recording state of the recording unit.
Figure 6:
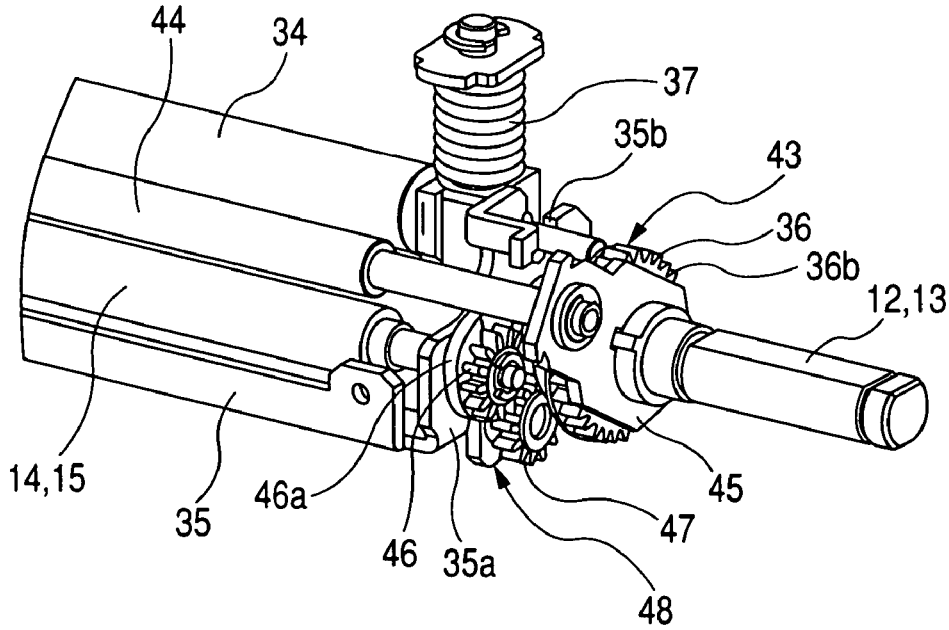
FIG. 6 is an enlarged schematic perspective view illustrating the essential parts in the vicinity of one end of a carrying roller in a recording state of the recording unit, seen from a different angle.
Figure 7:
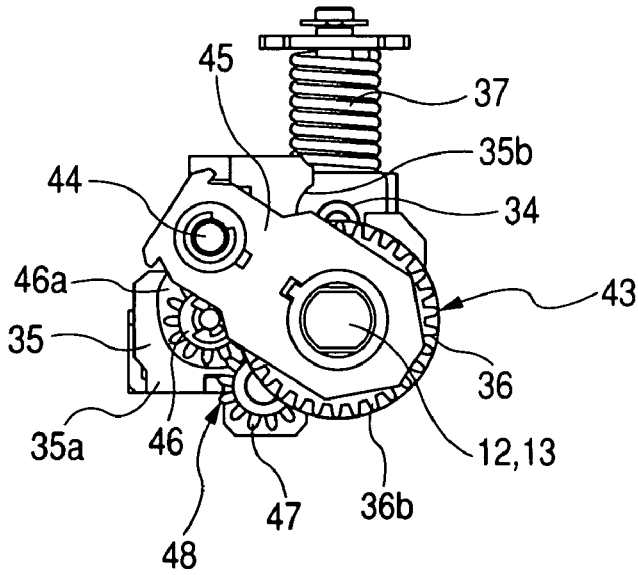
FIG. 7 is a side view of the essential parts of FIG. 6.
Figure 8:
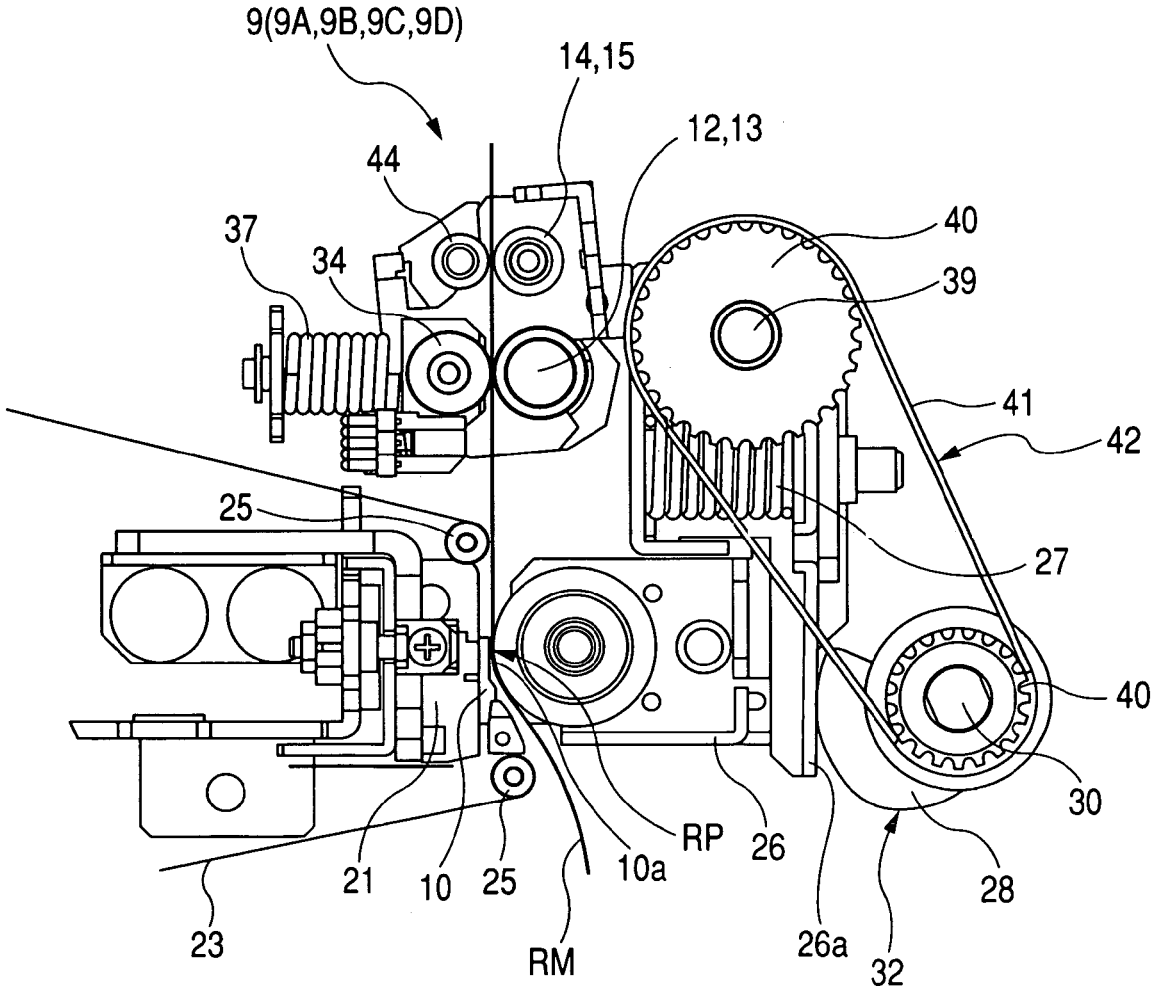
FIG. 8 is an enlarged schematic view illustrating essential parts in the vicinity of a rotation transmission mechanism in a recording state of the recording unit.
Figure 9:
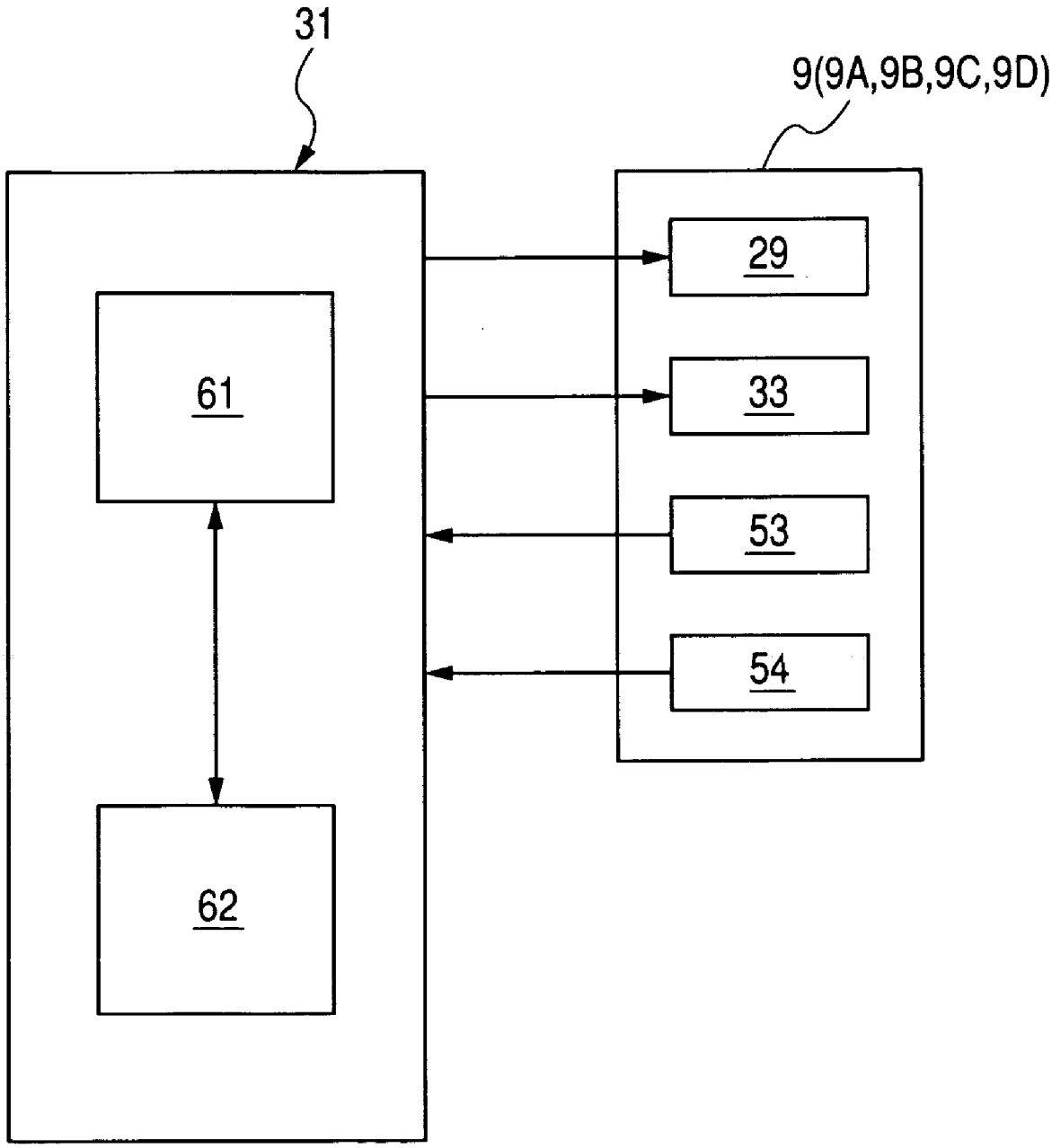
FIG. 9 is a block diagram illustrating essential parts of a control section.

FIG. 3 is an enlarged schematic view illustrating the essential parts of the recording unit, FIG. 4 is an enlarged schematic view illustrating the essential parts in the vicinity of a thermal head of the recording unit, FIG. 5 is an enlarged schematic view illustrating the essential parts in the vicinity of an interlocking means, FIG. 6 is an enlarged schematic perspective view illustrating the essential parts in the vicinity of one end of the carrying roller, seen from a different angle, FIG. 7 is a side view of the essential parts of FIG. 6, FIG. 8 is an enlarged schematic view illustrating essential parts in the vicinity of a rotation transmission mechanism, and FIG. 9 is a block diagram illustrating essential parts of a control section.

The recording unit 9 of the present embodiment has the line thermal head 10 which is formed in a substantially flat-plate shape. The line thermal head 10 is fixedly disposed so that its longitudinal direction coincides with the direction orthogonal to the carrying direction of the recording medium RM. On a recording surface 10*a* of the line thermal head 10 facing the carrying path, multiple heat generating elements are arranged in the direction orthogonal to the carrying direction of the recording medium RM when recording is performed. That is, the multiple heat generating elements are arranged over a length corresponding to the length for the row direction in the recording range orthogonal to the carrying direction of the recording medium RM.

The line thermal head 10 is attached to a head mount 21. The head mount 21 has a reinforcement function of ensuring the rigidity of the line thermal head 10 and serves as a heat sink or the like in a recording operation of the line thermal head 10. The head mount 21 is made of a metallic material such as an aluminum alloy which is light and excellent in heat radiation (heat conduction property). Moreover, the head mount 21 may be provided with an additional heat sink such as a water-cooling heat sink to further enhance a heat radiation property, according to the requirements in a design concept.

As shown in FIG. 3, a ribbon cassette 16 is arranged on the left side of the line thermal head 10. An ink ribbon 23 wound between a pair of rotatable rollers 22 is arranged inside the ribbon cassette 16. The ink ribbon 23 is guided by a plurality of ribbon guide rollers 24 rotatably arranged in the ribbon cassette 16 and by a pair of outer guide rollers 25 rotatably arranged on the upper and lower side (upstream and downstream) of the line thermal head 10 in FIG. 3, so that a traveling path of the ink ribbon 23 derived from the ribbon cassette 16 passes between the line thermal head 10 and the platen roller 11. At this moment, the ink ribbon 23 is carried so that an ink-coated surface of the ink ribbon 23 opposes the recording medium RM and the rear surface of the ink ribbon 23 opposite to the ink-coated surface opposes the heat generating elements of the line thermal head 10. The ribbon cassette 16 is detachably mounted on a cassette holder (not shown) arranged inside the thermal-printer main body 2. The ink ribbon 23 can be traveled by an ink ribbon traveling mechanism (not shown) which is conventionally known, when recording is performed.

As the ink ribbon 23 of the present embodiment, for example, the following ink ribbons are used, in order to form a full-color image on the recording medium RM. An ink ribbon 23 of a first recording unit 9A is coated with cyan (C) ink, an ink ribbon 23 of a second recording unit 9B is coated with magenta (M) ink, an ink ribbon 23 of a third recording unit 9C is coated with yellow (Y) ink, and an ink ribbon 23 of a fourth recording unit 9D is coated with transparent overcoat ink (OP).

Figure 10:
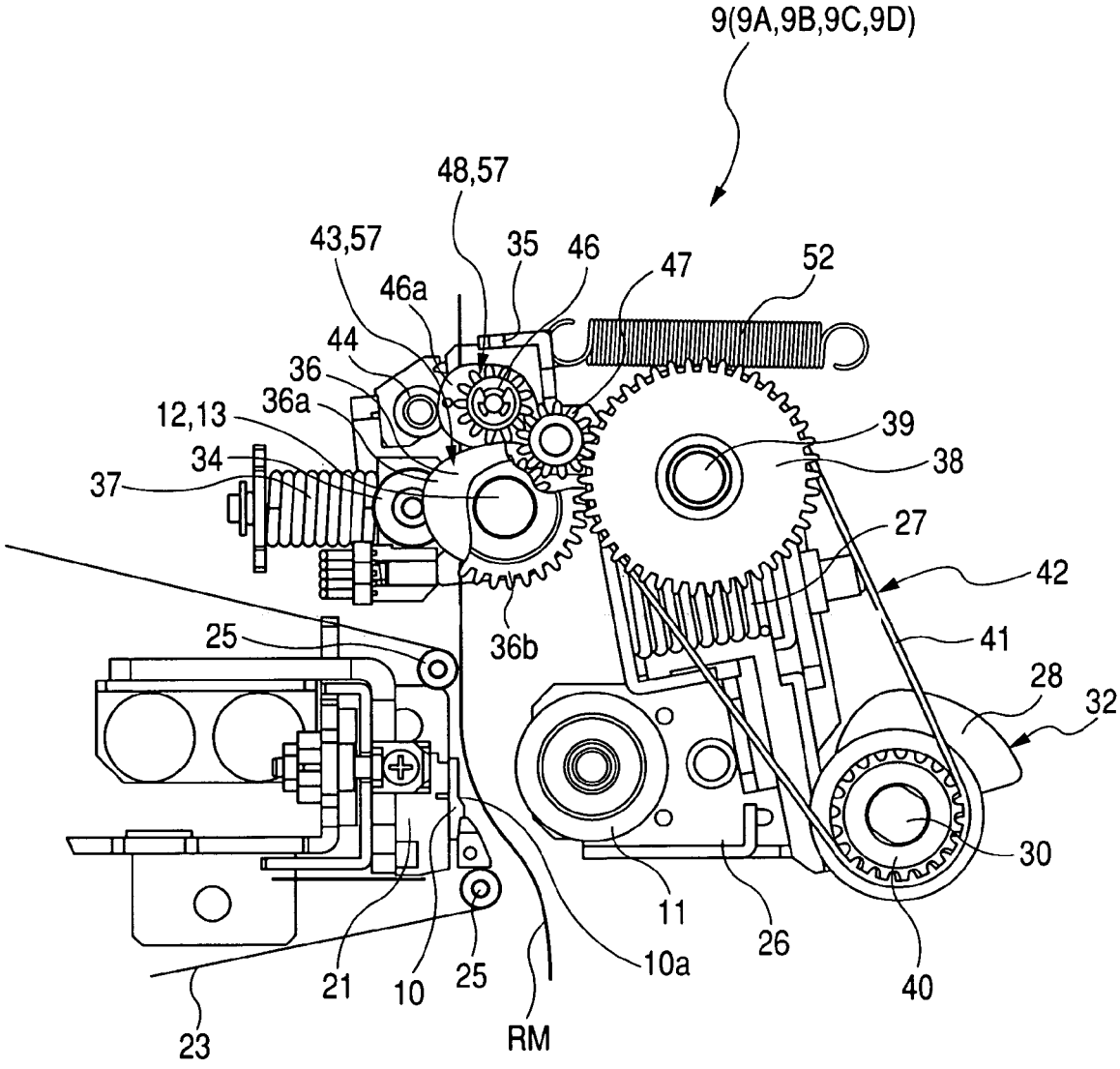
FIG. 10 is an enlarged schematic view illustrating essential parts in a standby state of the recording unit.

As shown in detail in FIGS. 4 and 5, a platen roller 11 is arranged at the position opposite to the line thermal head 10 with the ink ribbon 23 and the recording medium RM interposed therebetween. The platen roller 11 is slightly longer than the recording medium RM and the line thermal head 10. The platen roller 11 is rotatably supported by a platen supporting frame 26. On the right side of the platen supporting frame 26, a cam-receiving surface 26*a* is formed, and in the upper portion of the platen supporting frame 26, a head pressing spring 27 made of a compression coil is arranged. On the right side of the cam-receiving surface 26*a*, a head pressing cam 28 is arranged, which can be brought into contact with and separated from the cam-receiving surface 26*a*. The head pressing cam 28 is mounted on a head cam shaft 30 which can be rotatably driven by a driving force of a head-cam driving motor 29 (FIG. 9). When the head cam shaft 30 is rotatably driven by a driving force of the head-cam driving motor 29, the following two positions can be selectively taken. One of them is in a down position where the platen roller 11 is pressed against the line thermal head 10 by a spring force of the head pressing spring 27 shown in the FIG. 4. The other is in an up position where the platen roller 11 is separated from the line thermal head 10 (FIG. 10). The head-cam driving motor 29 is electrically connected to a control section 31 (FIG. 9) which will be described below.

In other words, the head-cam driving motor 29 is driven at a predetermined timing by a control instruction sent from the control section 31, so that the down position and the up position of the platen roller 11 can be switched over.

In a down state where the platen roller 11 is pressed against the line thermal head 10 with the recording medium RM interposed therebetween by a predetermined pressing force of the head pressing spring 27, the pressed position between the line thermal head 10 and the platen roller 11 is a recording position RP where ink of the ink ribbon 23 is transferred on the recording medium RM to perform recording.

The platen supporting cam 26, the head pressing spring 27, the head pressing cam 28, and the head cam shaft 30 constitute the head contacting/separating mechanism 32 of the present embodiment, by which the platen roller 11 is brought into contact with and separated from the line thermal head 10.

The head contacting/separating mechanism 32 may have a configuration where the line thermal head 10 is brought into contact with and separated from the platen roller 11 or the line thermal head 10 and the platen roller 11 are relatively brought into contact with and separated from each other.

Moreover, the up position of the platen 11 may be set so that an extended line of the carrying path connecting the contact positions where the line thermal head 10 and the carrying roller 12 contact the recording medium RM, in a recording state of the upstream recording unit 9, that is, in the down state of the platen roller 11, is located on the side of the recording medium RM from the center of the platen roller 11 in the up state of the downstream recording unit 9. Accordingly, even when the respective recording units 9 are arranged in the up and down directions in the recording section 4, the recording medium RM can be reliably supplied to the recording position RP of the downstream recording units 9.

In other words, if the center of the platen roller 11 in the up state of the downstream recording unit 9 is toward the carrying path with respect to an extended line of the carrying path connecting the recording position RP of the upstream recording unit 9 and the contact position between where the carrying roller 12 contacting the recording medium RM, the leading end of the recording medium RM, which is directed to the downstream recording unit 9, can be reliably carried between the recording surface 10*a* of the line thermal head 10 and the platen roller 11.

When the respective recording units 9 in the recording section 4 are arranged in a horizontal direction, the operation distance between the up state and the down state of the platen 11 can be made short, because the leading end of the recording medium RM falls down due to its own weight.

As shown in detail in FIGS. 4 and 5, on the upper side, i.e. the downstream side of the carrying path of the platen roller 11, the carrying roller 12 is arranged to carry the recording medium RM passing through the recording position RP, that is, the line thermal head 10 to the downstream recording unit 9. The carrying roller 12 is arranged so that its axial direction, i.e. its longitudinal direction orthogonal to the carrying direction of the recording medium RM is parallel to the platen roller 11. The carrying roller 12 is rotatably supported by a frame (not shown). A carrying and driving motor 33 (FIG. 9) is connected to at least one end of the carrying roller 12 through a rotation transmission mechanism (not shown) such as a gear transmission, a V-belt transmission, or a toothed belt transmission and the carrying roller 12 is formed so as to be rotationally driven by a driving force of the carrying and driving motor 33. The carrying and driving motor 33 is electrically connected to the control section 31. The carrying roller 12 is formed so as to be rotationally driven with a predetermined rotation speed at a predetermined timing by a control instruction sent from the control section 31.

On the left side of the outer circumferential surface of the carrying roller 12, that is, at a position opposite to the carrying roller 12 with the recording medium RM interposed therebetween, a carrying and pressing roller 34 is arranged, which is rotated to follow the carrying roller 12. As shown in FIGS. 7 and 8, the carrying and pressing roller 34 is fitted into a supporting groove 35*b* concaved at the upped end of a side panel 35*a* (only one side is shown in FIG. 6) of a roller-supporting frame 35 which is rotatably supported at both ends of the carrying roller 12, is rotatably arranged and reciprocate along the radial direction of the carrying roller 12, and is formed to rotate about the carrying roller 12.

Both ends of the carrying and pressing roller 34 project outward from both of the side panels 35*a* of the roller supporting frame 35. A cam 36*a* of a carrying/pressing lift cam gear 36 (FIG. 5) abuts on the respective outer circumferential surfaces of both ends of the carrying and pressing roller 34 with a spring force of a pressing and carrying spring 37 including a compression coil spring. The carrying/pressing lift cam gear 36 is rotatably arranged outside both of the side panels 35*a* of the roller-supporting frame 35. By rotating the carrying/pressing lift cam gear 36, the carrying and pressing roller 34 can be brought into contact with and separated from the outer circumferential surface of the carrying roller 12.

The carrying/pressing lift cam gear 36 is integrally and coaxially formed with a first gear 36*b* on the one side of the cam 36*a*, and the inner surface of the cam 36*a* is integrally and coaxially formed with a second gear 36*c* (FIG. 5). The first idle gear 38 is rotatably arranged outside both of the side panels 35*a* of the roller supporting frame 35. The first gear 36*b* meshes with the first idle gear 38 which is attached on a friction cam shaft 39 (FIG. 5). The friction cam shaft 39 is rotatably supported by the platen supporting frame 26. As shown in FIG. 8, the friction cam shaft 39 and the head cam shaft 30 are connected to each other by a rotation transmission mechanism 42 including a pair of toothed belt pulleys 40, which are attached on the friction cam shaft 39 and head cam shaft 30 respectively, and a toothed belt 41 wound between the pair of toothed belt pulleys 40.

In other words, the friction cam shaft 39 is rotationally driven by the rotation of the head cam shaft 30, so that the carrying and pressing roller 34 can be brought into contact with and separated from the outer circumferential surface of the carrying roller 12.

The rotation transmission mechanism 42 can be selected from various transmissions such as a gear transmission and a V-belt transmission.

The rotation transmission mechanism 42 and the carrying/pressing lift cam gear 36 constitute a carrying-and-pressing-roller contacting/separating mechanism 43 of the present embodiment, by which the carrying and pressing roller 34 is brought into contact with and separated from the outer circumferential surface of the carrying roller 12.

Accordingly, in the recording unit 9 according to the present embodiment, the carrying means 13 has the carrying roller 12 arranged on the downstream side of the line thermal head 10 and the carrying and pressing roller 34 opposing the carrying roller 12 with the carrying path interposed therebetween and provided to be brought into contact with and separated from the carrying roller 12. The carrying means 13 carries the recording medium RM, which has passed through the line thermal head 10, i.e. the recording position RP, to the downstream side. The carrying means 13 is formed so as to carry the recording medium RM interposed between the carrying roller 12 and the carrying and pressing roller 34.

The pressing contact of the carrying and pressing roller 34 against the outer circumferential surface of the carrying roller 12, which is accompanied by the rotation of the head cam shaft 30 and caused by the carrying-and-pressing-roller contacting/separating mechanism 43, is performed prior to the pressing contact of the platen roller 11 against the line thermal head 10, which is accompanied by the rotation of the head cam shaft 30 and caused by the head contacting/separating mechanism 32.

The carrying means 13 of the recording unit 9D of the present embodiment positioned on the most downstream side is used for delivering the recording medium RM to the discharge section 5 from the recording section 4.

On the upper side, i.e. the downstream side of the carrying path of the carrying roller 12, the friction roller 14 is arranged parallel to the carrying roller 12. The friction roller 14 can be rotated in a following manner by the friction with the recording medium RM. Both ends of the friction roller 14 are rotatably supported in both of the side panels 35*a* of the roller supporting frame 35. In other words, the friction roller 14 is formed to rotate about the carrying roller 12 (FIG. 6).

On the left side of the outer circumferential surface of the friction roller 14 in FIG. 4, that is, at a position opposite to the friction roller 14 with the recording medium RM interposed-therebetween, a friction pressing roller 44 is arranged, which can be rotated in a following manner by the friction with the recording medium RM. Both ends of the friction pressing roller 44 are respectively rotatably supported at the distal ends of a pair of movable plates 45. The proximal ends of the pair of movable plates 45 are respectively rotatably supported at both ends of the carrying roller 12 (FIGS. 6 and 7). In other words, the friction pressing roller 44 is also formed to rotate about the carrying roller 12. A cam 46*a* of a friction lift cam gear 46 abuts on the outer circumferential surfaces of both ends of the friction pressing roller 44 with a spring force of an urging spring (not shown) (FIGS. 5 to 7). The friction lift cam gear 46 is rotatably arranged outside both of the side panels 35*a* of the roller supporting frame 35. By rotating the friction lift cam gear 46, the friction pressing roller 44 can be brought into contact with and separated from the outer circumferential surface of the friction roller 14.

The gear of the friction lift cam gear 46 meshes with a second idle gear 47 rotatably arranged outside both of the side panels 35*a* of the roller supporting frame 35. The second idle gear 47 meshes with the second gear 36*c* of the carrying/pressing lift cam gear 36 (FIG. 5).

Accordingly, in the recording unit 9 of the present embodiment, the friction cam shaft 39 is rotationally driven by the rotation of the head cam shaft 30, the second gear 47 is rotated by the rotation of the carrying/pressing lift cam gear 36 accompanied by the rotation of the friction cam shaft 39, and then the friction lift cam gear 46 is rotated by the rotation of the second idle gear 47. Thereby, the friction pressing roller 44 can be brought into contact with and separated from the outer circumferential surface of the friction roller 14.

The carrying/pressing lift cam gear 36, the rotation transmission mechanism 42, the movable plate 45, the friction lift cam shaft 46 and the second idle gear 47 constitute a friction-pressing-roller contacting/separating mechanism 48 of the present embodiment, by which the friction pressing roller 44 is brought into contact with and separated from the outer circumferential surface of the friction roller 14.

Accordingly, in the recording unit 9 of the present embodiment, the following three kinds of contacting/separating operations can be interlocked. They include a contacting/separating operation of the platen roller 11 with respect to the line thermal head 10, a contacting/separating operation of the carrying and pressing roller 34 with respect to the outer circumferential surface of the carrying roller 12, and a contacting/separating operation of the friction pressing roller 44 with respect to the outer circumferential surface of the friction roller 14.

The pressing contact of the friction pressing roller 44 against the outer circumferential surface of the friction roller 14 by the friction-pressing-roller contacting/separating mechanism 48 is performed after the pressing contact of the carrying and pressing roller 34 against the outer circumferential surface of the carrying roller 12 by the carrying-and-pressing-roller contacting/separating mechanism 43 and prior to the pressing contact of the platen roller 11 against the line thermal head 10 by the head contacting/separating mechanism 32.

In the present embodiment, a friction means 15 has the friction roller 14 arranged on the downstream side of the carrying means 13 and the friction pressing roller 44 which opposes the friction roller 14 with the carrying path interposed therebetween and is provided to be brought into contact with and separated from the friction roller 14. The friction means 15 prevents disturbance generated on the downstream side from propagating upstream via the recording medium RM. The recording medium RM is pressed by the friction roller 14 and the friction pressing roller 44 so that a friction load can be applied to the recording medium RM.

As shown in FIG. 4, a friction attitude control cam 49 is attached on the friction cam shaft 39. The friction attitude control cam 49, having a concave portion 49*a* in a part of the outer circumferential surface, is formed in a disk shape. In addition, a cam pin 50 abuts on the friction attitude control cam 49. The cam pin 50 is attached on the base end of a substantially L-shaped dog frame 51 attached on the right surface of the roller supporting frame 35 in FIG. 4. The roller supporting frame 35 is always urged toward the right side of FIG. 4, i.e. in the clockwise direction of FIG. 4 about the carrying roller 12 by an urging force of a friction spring 52 including an extension spring. With the cam pin 50 abutting on the friction attitude control cam 49, a fixed state can be maintained, where the roller supporting frame 35, that is, the friction roller 14 of the friction means 15 is restricted from rotating about the carrying roller 12. Accordingly, the carrying path of the recording medium RM into the downstream recording unit 9 between a pair of adjacent recording units 9 can be reliably established.

Figure 16:
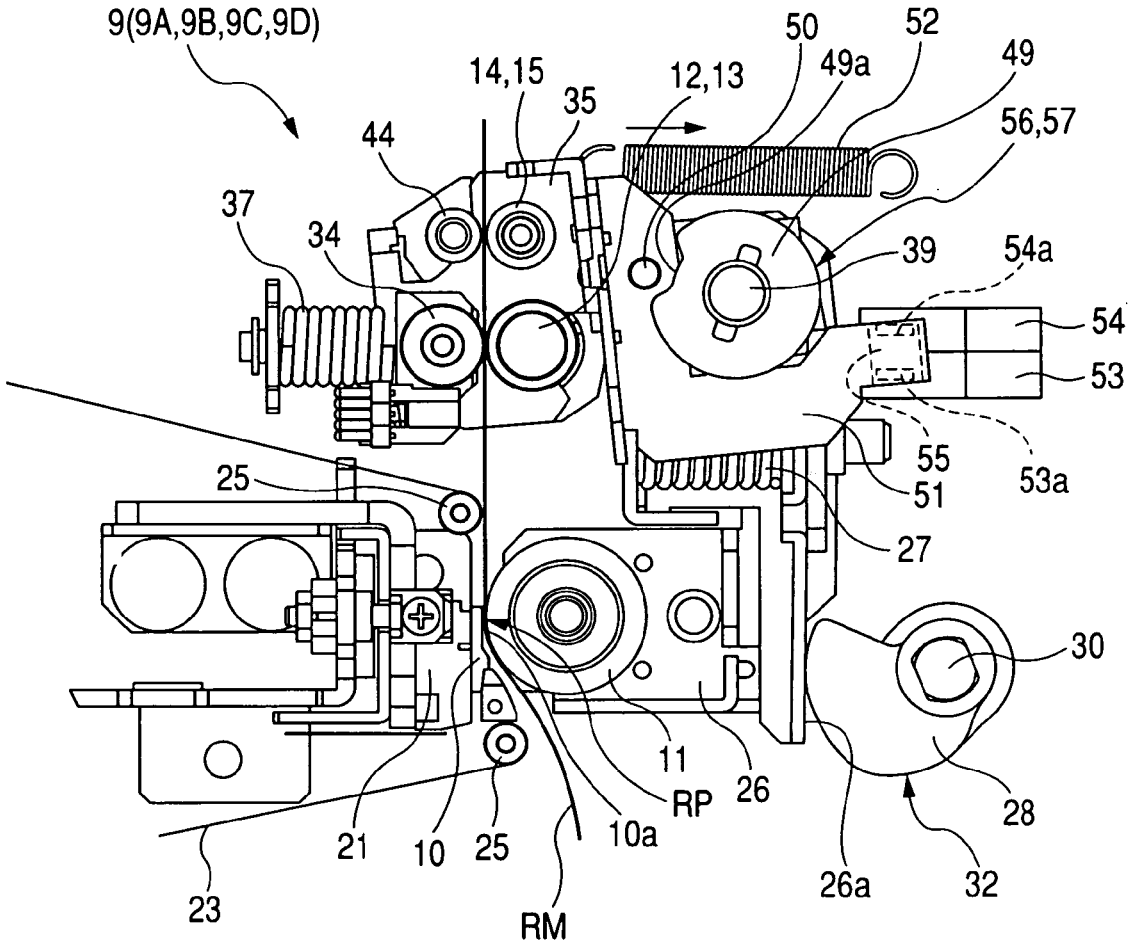
FIG. 16 is an enlarged schematic view illustrating the essential parts of the recording unit when a friction means is in a free state.

When the concave portion 49*a* of the friction attitude control cam 49 opposes the cam pin 50, the cam pin 50 falls into the concave portion 49*a* of the friction attitude control cam 49, which is referred to the free state. Accordingly, the respective portions attached on the friction roller 14 of the friction means 15, or more specifically the roller supporting frame 35 are formed to rotate about the carrying roller 12 (FIG. 16). The rotating position of the friction means 15 in the free state about the carrying roller 12 is variable according to a tension of the recording medium RM.

An upper limit and a lower limit in the rotation range of the friction roller 14 of the friction means 15 in the free state about the carrying roller 12 can be detected by an upper limit sensor 53 and a lower limit sensor 54 including a reflection-type optical sensor. The upper limit sensor 53 and the lower limit sensor 54 are electrically connected to the control section 31.

The upper limit sensor 53 and the lower limit sensor 54 function as a slack-determination sensor for determining whether the amount of slack of the recording medium RM when the recording medium RM is introduced into the downstream recording unit 9 is within an appropriate range or not. When the light emitted from the respective openings 53*a* and 54*a* of the upper limit sensor 53 and the lower limit sensor 54 is reflected by a reflection member 55 such as a reflection tape indicated by a dashed line in FIG. 4, it is determined whether the amount of slack of the recording medium RM is within an appropriate range. The reflection member 55 is fixed on one surface at the distal end of the dog frame 51. When only the light of the upper limit sensor 53 is reflected by the reflection member 55, it is determined that the amount of slack of the recording medium RM exceeds an upper limit. In addition, when only the light of the lower limit sensor 54 is reflected by the reflection member 55, it is determined that the amount of slack of the recording medium RM exceeds a lower limit. The determination for an appropriate range of the slack, an upper limit, and a lower limit is performed by the control section 31.

The above-described determination sensor is not limited to a reflection-type optical sensor but can be selected from various sensors such as a transmission-type sensor, a non-contact-type sensor such as a proximity switch, contact-type sensor such as a micro switch, and so on. In addition, a distance sensor may be used. In this case, the distance sensor may have a configuration where the distance from the distal end of the dog frame 51 is measured. Accordingly, the number of determination sensors to be used can be one and an analog value of the amount of slack can be determined. In addition, a potentiometer and a rotary encoder can be used. In this case, they may have a configuration where a rotation angle of the friction cam shaft 39 is measured. In such a configuration, the number of determination sensors to be used can be one and an analog value of the amount of slack can be determined.

Accordingly, in the recording unit 9 according to the present embodiment, the friction cam shaft 39 is rotationally driven by the rotation of the head cam shaft 30, and the friction attitude control cam 49 is rotated by the rotation of the friction cam shaft 39. Therefore, the following states can be easily switched over. One of the states is a fixed state of the friction roller 14, that is, a fixed attitude of the roller supporting frame 35 in which the friction attitude control cam 49 abuts on the cam pin 50. The other is a free state where the friction roller 14 can be rotated about the carrying roller 12, that is, a free attitude of the roller supporting frame 35 in which the concave portion 49*a* of the friction attitude control cam 49 opposes the cam pin 50 in a non-contact state.

In the recording unit 9 according to the present embodiment, the following four operations are performed sequentially by the rotation of the head cam shaft 30. They are a pressing operation of the carrying and pressing roller 34 against the carrying roller 12, a pressing operation of the friction pressing roller 44 against the friction roller 14, a pressing operation of the platen roller 11 against the line thermal head 10, and a switching operation for switching over from the fixed state to the free state for the friction roller.

The rotation transmission mechanism 42, the friction attitude control cam 49, and the cam pin 50 constitute a friction-roller state-switching mechanism 56 of the present embodiment, which switches from the fixed state to the free state for the friction roller 14 of the friction means 15.

Subsequently, in the recording unit 9 according to the present embodiment, a switching operation of switching over from the fixed state to the free state for the friction roller 14 of the friction means 15 can be further interlocked in addition to the following three kinds of contacting/separating operations. They are a contacting/separating operation of the platen roller 11 with respect to the line thermal head 10, a contacting/separating operation of the carrying and pressing roller 34 with respect to the outer circumferential surface of the carrying roller 12, and a contacting/separating operation of the friction pressing roller 44 with respect to the outer circumferential surface of the friction roller 14.

The switching operation of switching over from the fixed state to the free state for the friction roller 14 of the friction means 15 by the friction-roller state-switching mechanism 56 is performed after the plate roller 11 is pressed against the line thermal head 10 by the head contacting/separating mechanism 32. More specifically, the above operation is performed after the recording medium RM is supplied to the downstream recording unit 9 to be interposed between the carrying roller 12 of the downstream recording unit 9 and the carrying and pressing roller 34.

The carrying-and-pressing-roller contacting/separating mechanism 43, the friction-pressing-roller contacting/separating mechanism 48, and the friction-roller state-switching mechanism 56 constitute an interlocking means 57 which interlocks the following operations, sequentially of the present embodiment. The operations are a pressing operation of the carrying and pressing roller 34 against the carrying roller 12, a pressing operation of the friction pressing roller 44 against the friction roller 14, a switching operation of switching over from the fixed state to the free state for the friction roller 14 of the friction means 15.

As shown in FIG. 9, the thermal printer 1 of the present embodiment has the control section 31 for controlling operations of the respective portions. The control section 31 has at least a CPU 61 and a memory 62 such as a ROM and a RAM having appropriate capacity. The control section 31 is electrically connected to at least the head-cam driving motors 29, the carrying and driving motor 33, the upper limit sensor 53, the lower limit sensor 54, a power switch (not shown) and a variety of known switches which are related to a recording operation, among the respective recording units 9.

The memory 62 of the present embodiment stores a program for determining whether the amount of slack of the recording medium RM to be supplied to the downstream recording unit 9 is within an appropriate range, based on a detection signal sent from any one of the upper limit sensor 53 and the lower limit sensor 54.

For example, based on an ON signal sent when the light emitted from the upper limit sensor 53 and the lower limit sensor 54 is reflected by the reflection member 55, it is determined by the program that the amount of slack of the recording medium RM is within an appropriate range in the case where an ON signal is sent from both of the upper limit sensor 53 and the lower sensor 54. Further, it is determined whether the amount of slack of the recording medium RM exceeds an upper limit in the case where an ON signal is sent only from the upper limit sensor 53, and it is determined that the amount of slack of the recording medium RM exceeds a lower limit in the case where an ON signal is sent only from the lower limit sensor 54.

The slack determination is performed, for example, by a medium detecting sensor or a recording-starting-position detecting sensor which are not shown, when it is detected that the recording medium RM has been supplied to the recording unit 9.

The medium detecting sensor is electrically connected to the control section 31. When the leading end of the recording medium RM passes in front of the carrying roller 12 in the carrying path, the medium detecting sensor sends the detection signal to the control section 31. The control section 31 receiving the detection signal determines that the recording medium RM is 'present'.

The memory 62 stores a program for controlling the carrying speed of the recording medium RM by the carrying means 13 of the upstream recording unit 9 so that the amount of slack of the recording medium RM to be supplied to the downstream recording unit 9 falls within an appropriate range, when it is determined that the amount of slack determined by the upper limit sensor 53 and the lower limit sensor 54 as a determination sensor is not within an appropriate range.

Specifically, when it is determined that the amount of slack of the recording medium RM exceeds an upper limit, a program can be exemplified, which controls the rotation speed of the carrying and driving motor 33 to decrease so that the carrying speed of the recording medium RM decreases. The carrying and driving motor 33 drives the carrying roller 12 to be rotated. When it is determined that the amount of slack of the recording RM exceeds a lower limit, a program can be exemplified, which controls the rotation speed of the carrying and driving motor 33 to increase so that the carrying speed of the recording medium RM increases. The carrying and driving motor 33 drives to rotate the carrying roller 12.

The memory 62 stores a program for controlling operations and operation sequence of the respective portions, various programs for performing an initialization operation when power is input, and various data which are required for performing a recording operation.

Next, an operation of the present embodiment having the above-described configuration will be described with reference to FIGS. 1 to 18.

Figure 11:
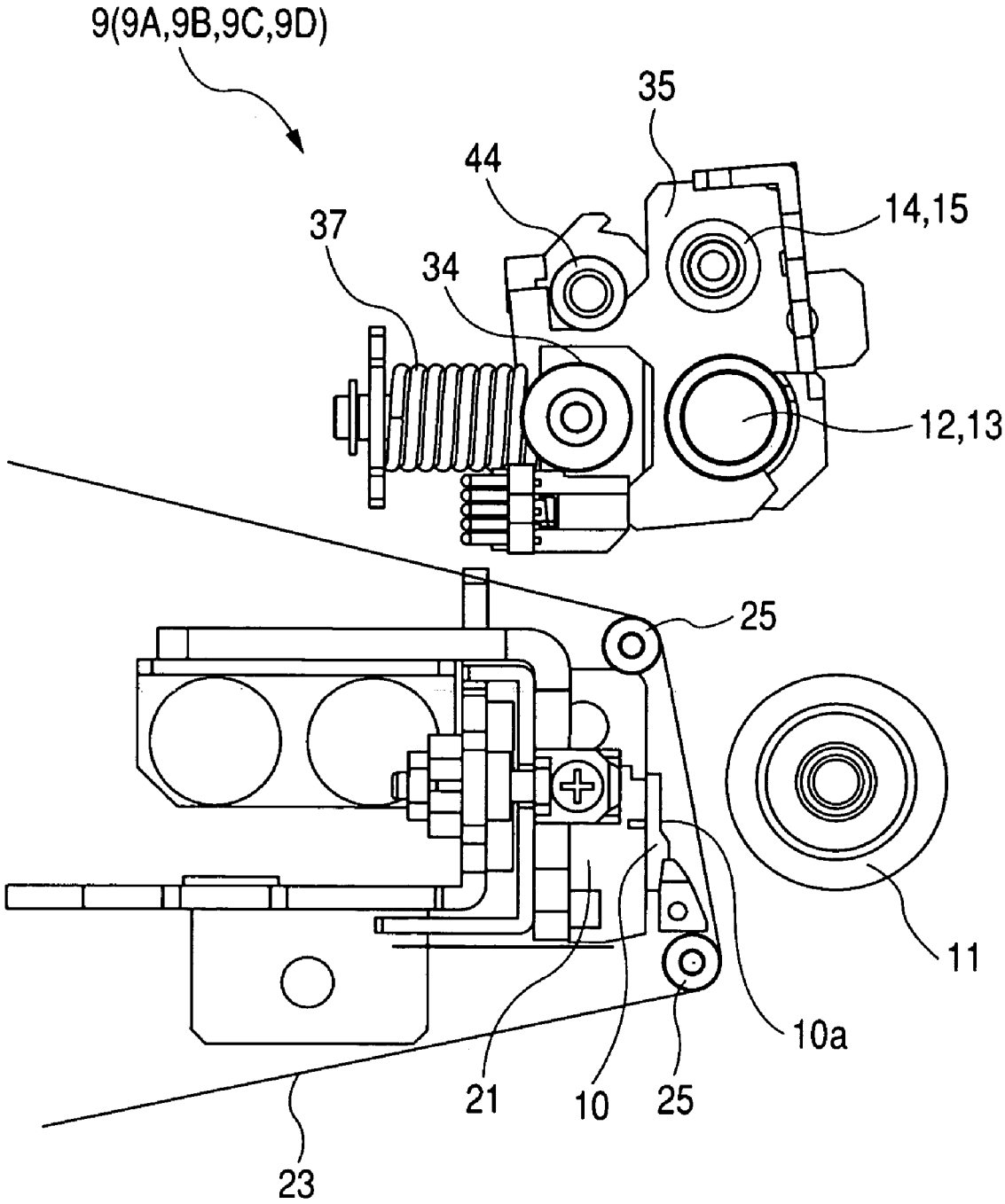
FIG. 11 is an enlarged schematic view illustrating the essential parts of the interlocking means in a standby state of the recording unit.
Figure 12:
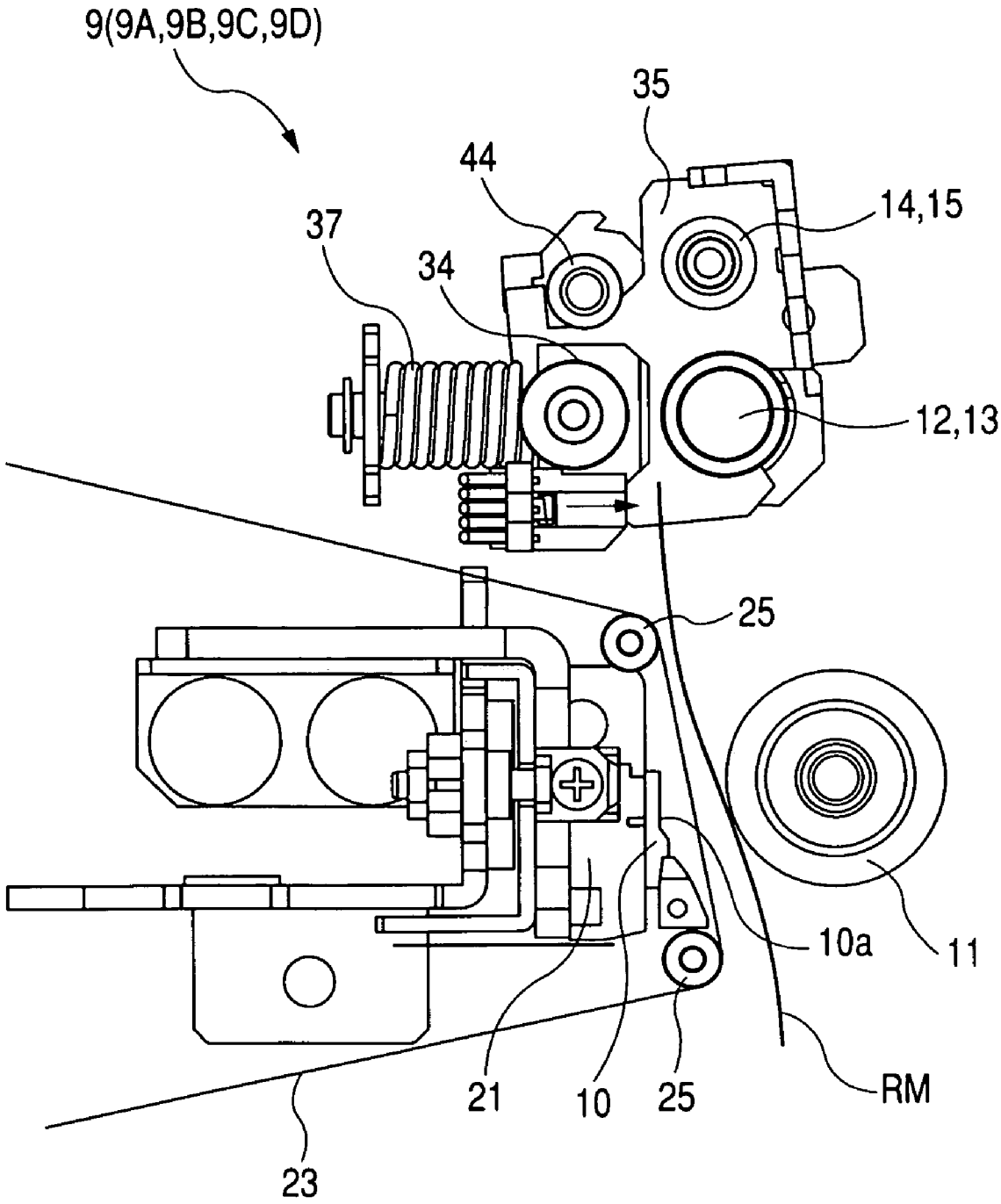
FIG. 12 is an enlarged schematic view illustrating the essential parts of the recording unit when a recording medium is supplied immediately in front of the carrying roller.
Figure 13:
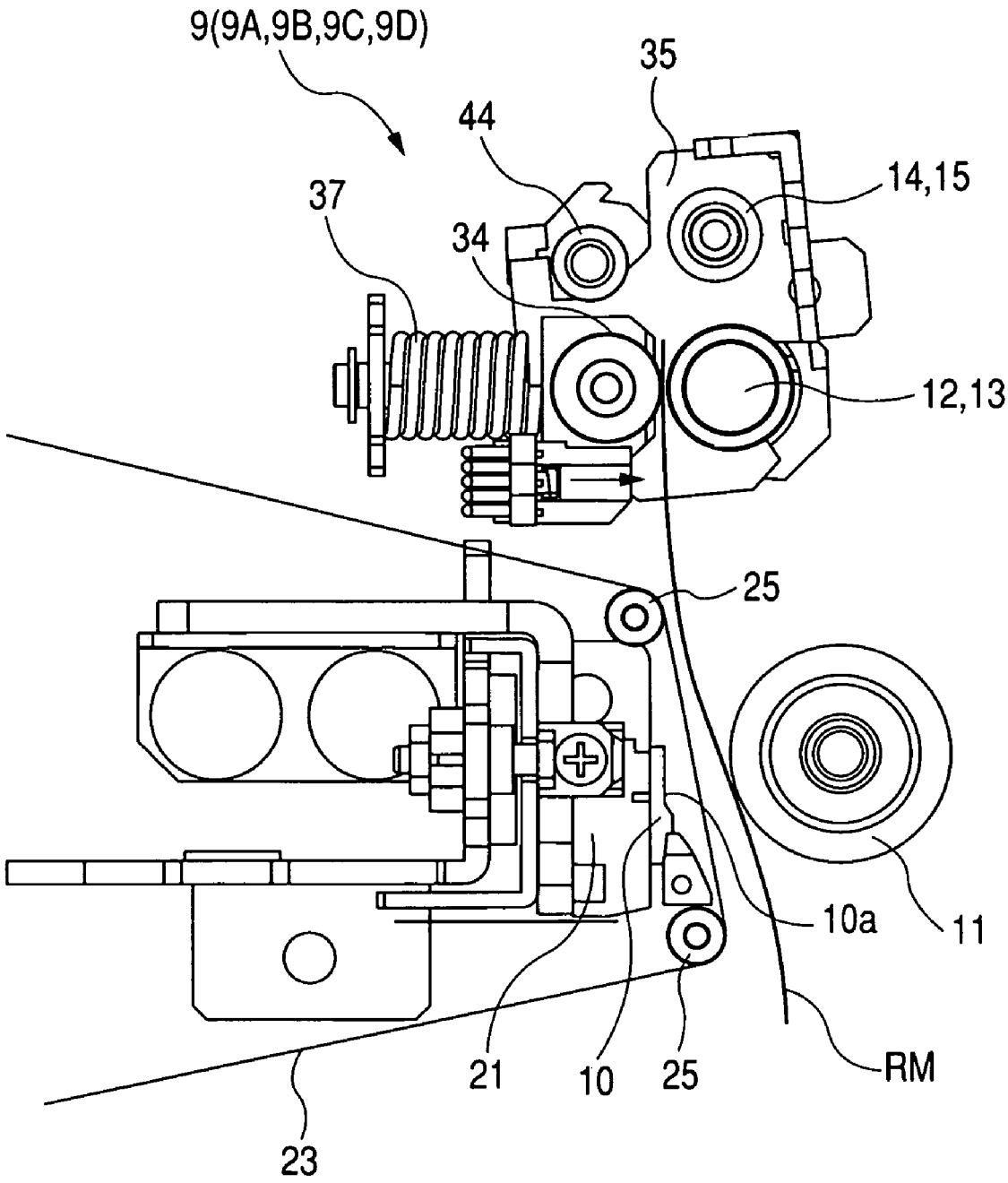
FIG. 13 is an enlarged schematic view illustrating the essential parts of the recording unit when the carrying roller is pressed.
Figure 14:
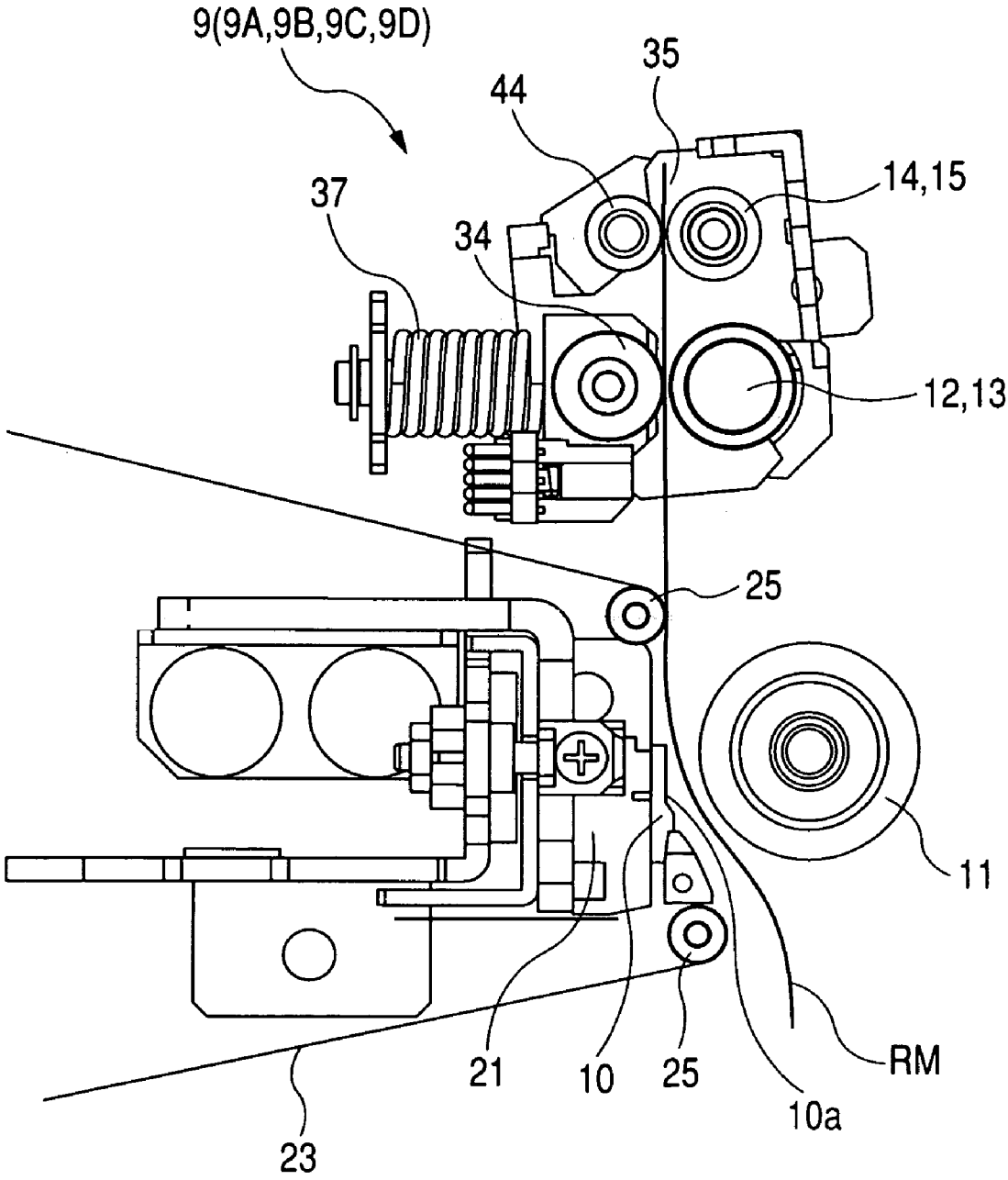
FIG. 14 is an enlarged schematic view illustrating the essential parts of the recording unit when a friction roller is pressed.
Figure 15:
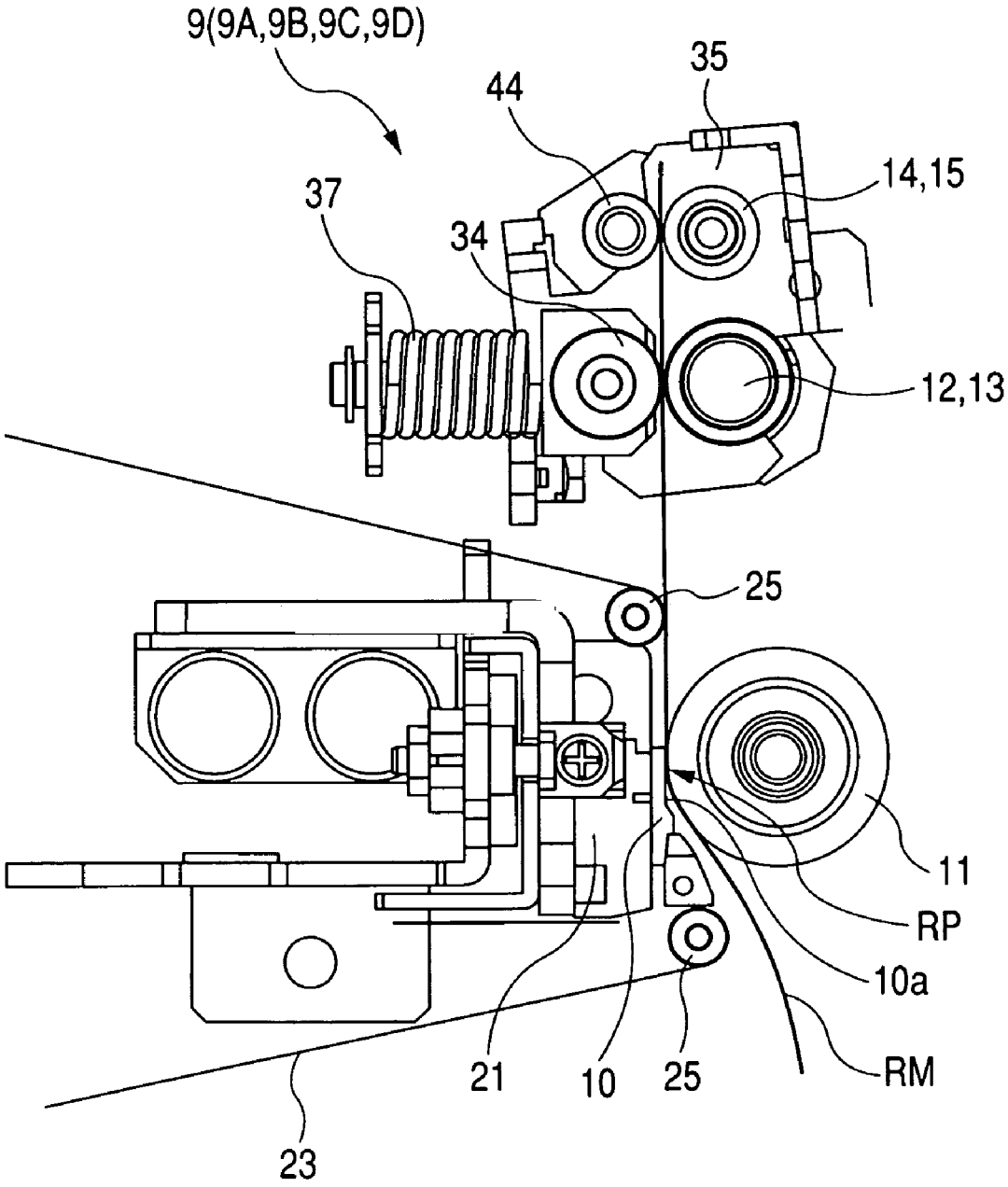
FIG. 15 is an enlarged schematic view illustrating the essential parts of the recording unit when a head is pressed.
Figure 17:
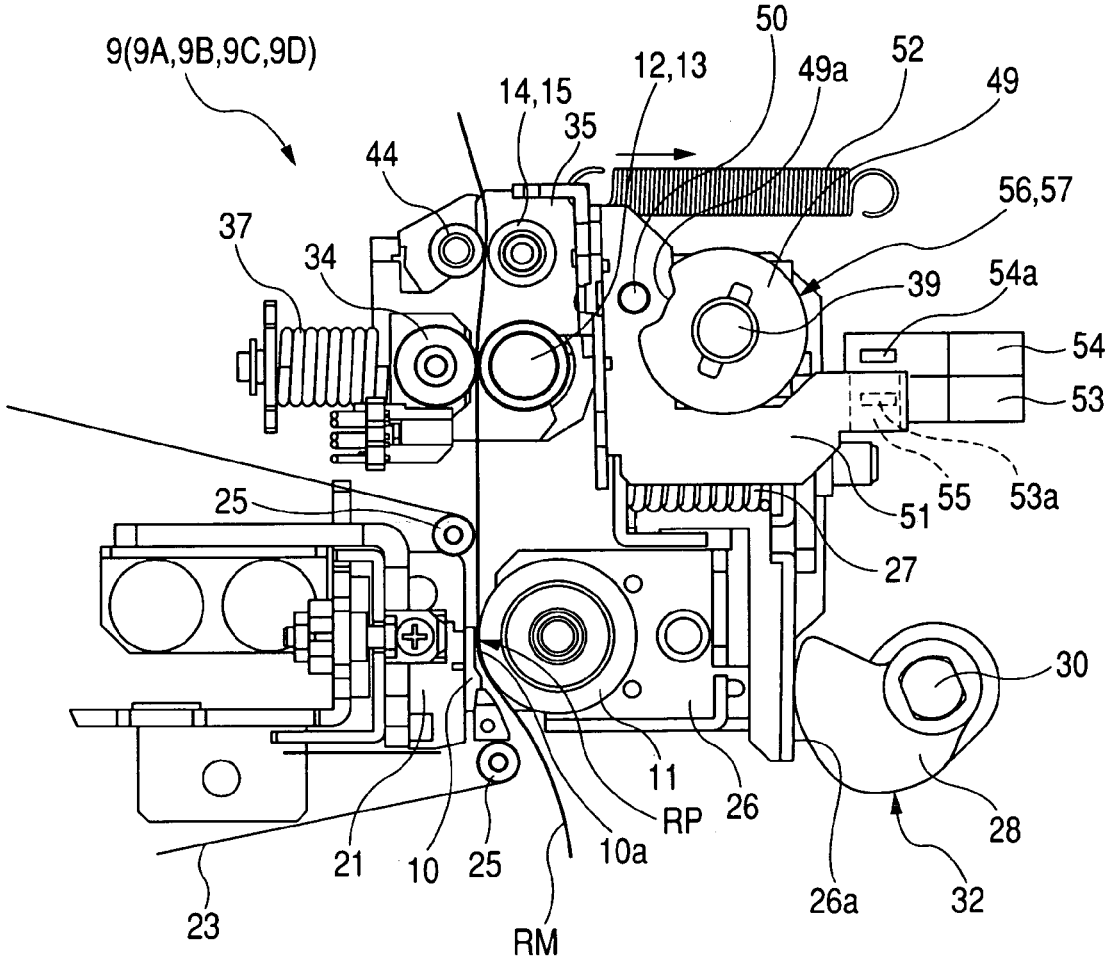
FIG. 17 is an enlarged schematic view illustrating the essential parts of the recording unit when the slack of the recording medium exceeds an upper limit.
Figure 18:
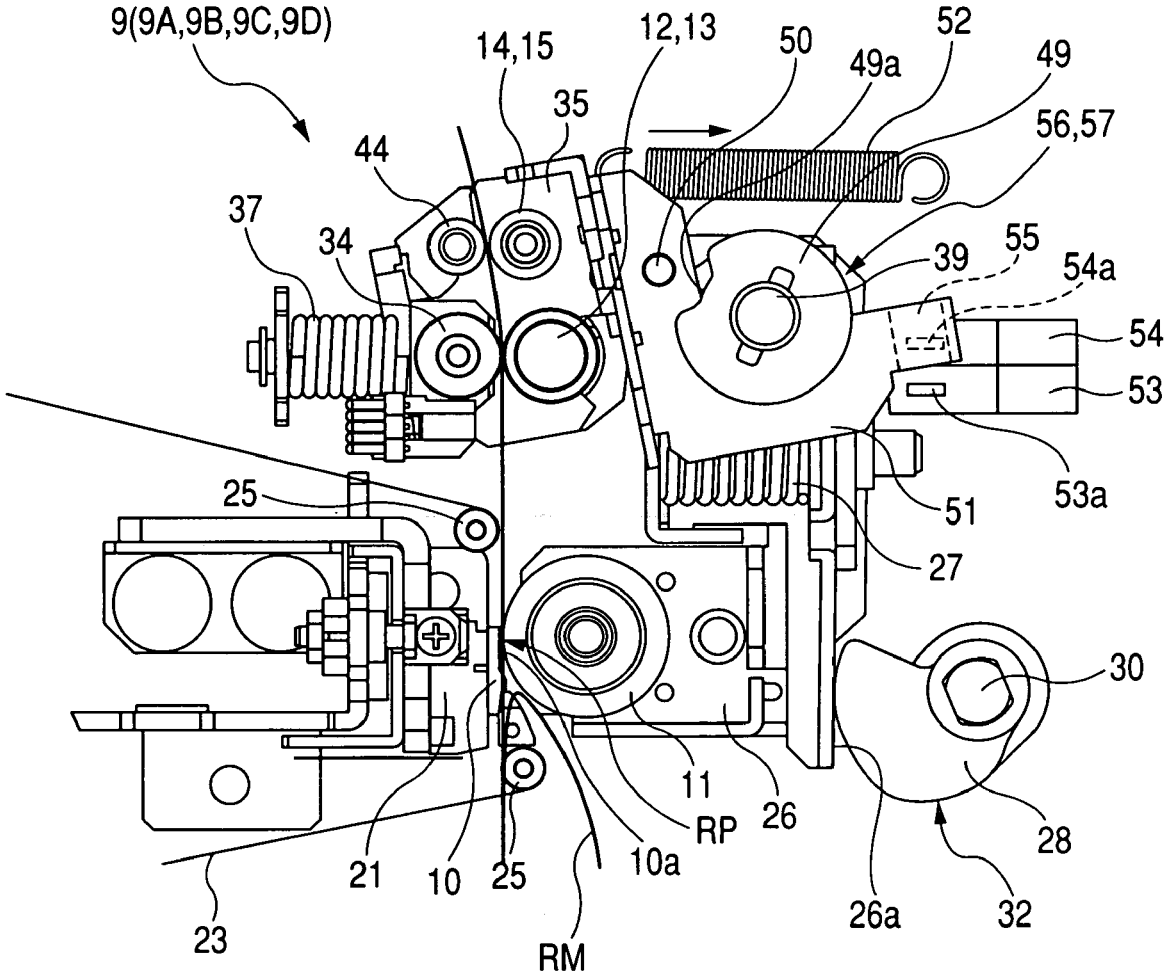
FIG. 18 is an enlarged schematic view illustrating the essential parts of the recording unit when the slack of the recording medium exceeds a lower limit.

FIG. 1 shows a recording state of the thermal printer, FIG. 2 shows a state where a recording medium is introduced into the third recording unit, FIGS. 3 to 8 shows a recording state of the recording unit, FIG. 10 is an enlarged schematic view illustrating essential parts in a standby state of the recording unit, FIG. 11 is an enlarged schematic view illustrating the essential parts of the interlocking means in a standby state of the recording unit, FIG. 12 is an enlarged schematic view illustrating the essential parts of the recording unit when a recording medium is supplied immediately in front of the carrying roller, FIG. 13 is an enlarged schematic view illustrating the essential parts of the recording unit when the carrying roller is pressed, FIG. 14 is an enlarged schematic view illustrating the essential parts of the recording unit when the friction roller is pressed, FIG. 15 is an enlarged schematic view illustrating the essential parts of the recording unit when the head is pressed, FIG. 16 is an enlarged schematic view illustrating the essential parts of the recording unit when the friction means is in the free state, FIG. 17 is an enlarged schematic view illustrating the essential parts of the recording unit when the amount of slack of the recording medium exceeds an upper limit, and FIG. 18 is an enlarged schematic view illustrating the essential parts of the recording unit when the amount of slack of the recording medium exceeds a lower limit.

If image data such as desired characters, figures or the like are input into the thermal printer 1 of the present embodiment, the thermal printer 1 first carries the recording medium RM to the first recording unit 9A positioned in the most upstream side of the respective recording units 9 from the supply roller 6 of the supply section 3.

At this moment, the respective recording units 9 are in a standby state. In the standby state of the recording units 9, the platen roller 11 is separated from the recording surface 10*a* of the line thermal head 10, the carrying and pressing roller 34 is separated from the outer circumferential surface of the carrying roller 12, and the friction pressing roller 44 is separated from the outer circumferential surface of the friction roller 14, as shown in FIG. 10.

In other words, the head pressing cam 28 of the head contacting/separating mechanism 32 gets separated from the cam receiving surface 26*a* of the platen supporting frame 26, as shown in FIG. 11. The platen roller 11 gets separated from the recording surface 10*a* of the line thermal head 10 to maintain the up state, as shown in FIGS. 10 and 11.

In the carrying/pressing lift cam gear 36 of the carrying-and-pressing-roller contacting/separating mechanism 43, the top of the cam 36*a* abuts on the outer circumferential surface of both ends of the carrying and pressing roller 34. The carrying and pressing roller 34 is separated from the outer circumferential surface of the carrying roller 12.

In the friction lift cam gear 46 of the friction-pressing-roller contacting/separating mechanism 48, the top of the cam 46*a* abuts on the outer circumferential surface of both ends of the friction pressing roller 44. The friction pressing roller 44 rotates about the carrying roller 12 in the direction away from the movable plate 45 (FIGS. 6 and 7) and the friction roller 14, to be separated from the outer circumferential surface of the friction roller 14.

The friction attitude control cam 49 of the friction-roller state-switching mechanism 56 abuts on the cam pin 50 so that the friction means 15 is in the fixed state (refer to FIG. 4).

Next, if the recording medium RM is supplied to the first recording unit 9A from the supply section 3, the leading end of the recording medium RM passes between the platen roller 11 and the recording surface 10*a* of the line thermal head 10 of the first recording unit 9A to be carried toward between the carrying roller 12 and the carrying and pressing roller 34, as shown in FIG. 12. If the leading end of the recording medium RM passes between the carrying roller 12 and the carrying and pressing roller 34, the head-cam driving motor 29 is driven by a control instruction sent from the control section 31, so that the head cam shaft 30 rotates at a predetermined angle in the counterclockwise direction in FIG. 10. As shown in FIG. 13, the interlocking means 56 is driven by the rotation of the head cam shaft 30, and the carrying-and-pressing-roller contacting/separating mechanism 43 presses the carrying and pressing roller 34 against the carrying roller 12 with the recording medium RM interposed therebetween, which is referred to as the carrying-roller-pressed state. At the same time when the carrying and pressing roller 34 is pressed against the carrying roller 12, the carrying and driving motor 33 is driven by a control introduction sent from the control section 31 to carry the recording medium RM interposed between the carrying roller 12 and the carrying and pressing roller 34 to the second downstream recording unit 9B. After that, the carrying roller 12 continues to carry the recording medium RM at a predetermined speed toward the downstream side, without being driven intermittently.

The drive timing of the head-cam driving motor 29 is controlled on the basis of the point of time when a 'presence' signal for the presence or absence of the recording medium RM is sent to the control section 31 so that the control section 31 determines that the recording medium RM is 'present'. The drive timing is controlled, for example, by a medium detecting sensor or a recording-starting-position detecting sensor which are not shown and arranged in front of the carrying roller 12 in the carrying path.

Next, if the leading end of the recording medium RM passes between the friction roller 14 and the friction pressing roller 44, the head-cam driving motor 29 is further driven by a control instruction sent from the control section 31 so that the head cam shaft 30 further rotates in the counterclockwise. By the rotation of the head cam shaft 30, the interlocking means 56 is further driven so that the carrying-roller-pressed state is maintained, as shown in FIG. 14, and the friction-pressing-roller contacting/separating mechanism 48 presses the friction pressing roller 44 against the friction roller 14 with the recording medium RM interposed therebetween. The recording medium RM is pressed by the friction roller 14 and the friction pressing roller 44 so that a friction load is applied to the recording medium RM, which is referred to as the friction-roller-pressed state.

Next, after the friction pressing roller 44 is pressed against the friction roller 14 with the recording medium RM interposed therebetween, the head-cam driving motor 29 is further driven and the head cam shaft 30 rotates in the counterclockwise direction. By the rotation of the head cam shaft 30, the interlocking means 56 is further driven so that the carrying-roller-pressed state and the friction-roller-pressed state are maintained, as shown in FIG. 15. At the same time, the head contacting/separating mechanism 32 causes the platen roller 11 to press the recording medium RM and the ink ribbon 23, in the mentioned order against the recording surface 10*a*, which is referred to as the head-pressed state. Before the friction pressing roller 44 is completely pressed against the friction roller 14, the platen roller 11 moves toward the line thermal head 10 through the rotation of the head cam shaft 30 to be close to the line thermal head 10. In this period, the carrying roller 12 carries the recording medium RM to the downstream side, and the head is pressed while the carrying roller 12 carries the recording medium RM to the downstream side.

In the head-pressed state, the heat generating elements of the line thermal head 10 are selectively driven (heat-generated) based on recording information and the ink ribbon 23 is carried, by a control instruction sent from the control section 31. Therefore, a recording operation of the first recording unit 9A begins, in which a predetermined color, for example, ink (C) is transferred onto the image-forming region of the recording medium RM from the ink ribbon 28 (FIG. 2, FIG. 3, and FIGS. 5 to 8)

Subsequently, if the leading end of the recording medium RM passes between the platen roller 11 and the recording surface 10*a* of the line thermal head 10 of the second recording unit 9B by the carrying roller 12 of the first recording unit 9A, the head-cam driving mechanism 29 of the second recording unit 9B is driven by a control instruction sent from the control section 31, similarly to the above-described first recording unit 9A. Then, the respective portions of the second recording unit 9B go sequentially through the above-described standby state, the carrying-roller-pressed state, the friction-roller-pressed state, and the head-pressed state. After that, a recording operation by the second recording unit 9B begins and a different color, for example, ink (M) is transferred onto the image formed by the first recording unit 9A from the ink ribbon 28 to perform recording.

At this time, the friction means 15 of the first recording unit 9A establishes the carrying path into the second recording unit 9B.

When the platen roller 11 of the second recording unit 9B is in the down state, an image is recorded by the first recording unit 9A. However, the recording medium RM is pressed by the friction means 15 of the first recording unit 9A, or specifically the friction roller 14 and the friction pressing roller 44, so that a friction load is applied to the recording medium RM. Therefore, when the platen roller 11 of the second recording unit 9B is in the down state, the impact against the recording medium RM can be reliably prevented from being transmitted to the portion, where carrying and recording of the first recording unit 9A are performed, through the recording medium RM.

In other words, the friction means 15 can reliably and easily prevent the disturbance, which is generated on the downstream side between a pair of adjacent recording units 9, from propagating upstream via the recording medium RM.

The carrying path, connecting the line thermal head 10 and the carrying roller 12 in a recording state of the second downstream recording unit 9B, is disposed at a position shifted from the extended direction of the carrying path connecting the line thermal head 10 and the carrying roller 12 in a recording state of the first recording unit 9A. Therefore, when the recording medium RM is supplied, it can be loosened (curved).

In other words, between a pair of adjacent recording units 9, the carrying path connecting the carrying roller 12 and the line thermal head 10 of the downstream recording unit 9 is disposed substantially in a step shape, with respect to the carrying path connecting the contact positions where the carrying roller 12 and the line thermal head 10 of the upstream recording unit 9 in a recording state contact the recording medium RM. When the recording medium RM is supplied from the upstream recording unit 9 to the downstream recording unit 9, the carrying path of the recording medium RM can be formed so that the recording medium RM is loosened (curved). In addition, the friction roller 14 can establish the carrying path into the downstream recording unit 9 between a pair of adjacent recording units 9.

When the recording medium RM is supplied to the second recording unit 9B, for example, at the timing when the second recording unit 9B is at least in the carrying-roller-pressed state, the head-cam driving motor 29 of the first recording unit 9A is driven to move to the position where the cam pin 50 is opposite to the concave portion 49*a* of the friction attitude control cam 49 of the friction-roller state-switching mechanism 56. As shown in FIG. 16, the cam pin 50 gets separated from the concave portion 49*a* of the friction attitude control cam 49 in a non-contact state. Therefore, a free state is maintained, where the roller supporting frame 35, the friction means 15, the carrying and pressing roller 34 and the like can rotate about the carrying roller 12. The friction means 15 and the carrying and pressing roller 34 are attached on the roller supporting frame 35. As such, by switching over the fixed state to the free state for the friction roller 14 of the friction means 15, an error (speed difference) in carrying speed of the recording medium RM between the respective recording units 9 can be reduced.

In other words, a speed difference in carrying speed of the recording medium RM in the respective units 9 can be easily and reliably reduced by the rotation of the friction roller 14 about the carrying roller 12.

At this time when an ON signal is sent from both of the upper limit sensor 53 and the lower limit sensor 54 to the control section 31, the control section 31 determines that the amount of slack of the recording medium RM in the second recording unit 9B is within an appropriate range and controls the rotation speed of the carrying and driving motor 33 so that the rotation speed of the carrying roller 12 of the first recording unit 9A is maintained at a predetermined rotation speed.

As shown in FIG. 17, an ON signal is sent only from the upper limit sensor 53 to the control section 31, when the tension of the recording medium RM is weak so that the friction roller 14 is rotated about the carrying roller 12 in the clockwise direction by an urging force of the friction spring 52. In this case, the amount of slack of the recording medium is large. Therefore, when an ON signal is sent only from the upper limit sensor 53, the control section 31 determines that the amount of slack of the recording medium RM approaches an upper limit and controls the carrying speed of the recording medium RM by the carrying means 13 of the first recording unit 9A so that the amount of slack of the recording medium RM to be supplied to the second recording unit 9B falls within an appropriate range. In detail, the control section 31 controls the rotation speed of the carrying and driving motor 33 so as to reduce the rotation speed of the carrying roller 12.

In other words, by reducing the rotation speed of the carrying roller 12 of the upstream recording unit 9 of a pair of adjacent recording units 9, the tension of the recording medium RM to be carried to the downstream recording unit 9 increases, and the friction roller 14 rotates about the carrying roller 12 in the counterclockwise direction in FIG. 17. As a result, the amount of slack is reduced.

As shown in FIG. 18, an ON signal is sent only from the lower limit sensor 54 to the control section 31, when the tension of the recording medium RM is strong so that the roller supporting frame 35 is rotated about the carrying roller 12 in the counterclockwise direction against the urging force of the friction spring 52. In this case, the amount of slack of the recording medium is small. Therefore, when an ON signal is sent only from the lower limit sensor 54, the control section 31 determines that the amount of slack of the recording medium RM approaches a lower limit and controls the carrying speed of the recording medium RM by the carrying means 13 of the first recording unit 9A so that the amount of slack of the recording medium RM to be supplied to the second recording unit 9B falls within an appropriate range. In detail, the control section 31 controls the rotation speed of the carrying and driving motor 33 so as to increase the rotation speed of the carrying roller 12.

In other words, by increasing the rotation speed of the carrying roller 12 of the upstream recording unit 9 of a pair of adjacent recording units 9, the tension of the recording medium RM to be carried to the downstream recording unit 9 decreases and the friction roller 14 rotate about the carrying roller 12 in the clockwise direction in FIG. 18. As a result, the amount of slack is reduced.

In a similar way, in the third recording unit, a different color of ink, for example, ink (Y) is transferred onto the image formed by the second recording unit 9B from the ink ribbon 28 to perform recording so that a full color image is formed. Next, in the fourth recording unit, transparent overcoat ink (OP) is transferred onto the full color image from the ink ribbon 28 to perform recording. Then, recording of one image plane is completed.

FIG. 2 shows the carrying-roller-pressed state where the carrying and pressing roller 34 of the third recording unit 9C is pressed against the carrying roller 12 with the recording medium RM interposed therebetween.

The recording medium RM, on which an image is recorded by the recording section 4, is cut at a determined length by the cutting means 17 in the discharge section 5 to be accommodated sequentially in the tray 18.

At this moment, the next image is recorded by the fourth recording unit 9D. However, the recording medium RM is pressed by the friction means 15 of the fourth recording unit 9D, or specifically the friction roller 14 and the friction pressing roller 44 so that a friction load is applied to the recording medium RM. Therefore, the impact accompanied by the cutting of the recording medium RM with the cutting means can be reliably prevented from being transmitted to the portion where carrying and recording of the fourth recording unit 9D are performed, through the recording medium RM.

In other words, the friction means 15 can easily and reliably prevent the disturbance generated on the downstream side from propagating upstream via the recording medium RM.

According to the thermal printer 1 of the present embodiment, a plurality of the recording units 9, which are arranged along the carrying path of the long recording medium RM, respectively have the carrying means 13 including the carrying roller 12 arranged on the downstream side of the line thermal head 10 as a thermal head and the friction means 15 including the friction roller 14 arranged on the downstream side of the carrying means 13. Therefore, between the respective thermal heads 9, the disturbance generated on the downstream side, for example, the impact onto the recording medium RM accompanied by the down operation of the platen roller 11 in the downstream recording unit 9 can be reliably and easily prevented from propagating upstream via the recording medium RM.

Accordingly, the thermal head printer 1 of the present embodiment enables a recording quality to be improved easily.

According to the thermal printer 1 of the present embodiment, a plurality of the recording units 9, which are arranged along the carrying path of the long recording medium RM, respectively, have the carrying means 13 including the carrying roller 12 arranged on the downstream side of the line thermal head 10 as a thermal head and the friction means 15 including the friction roller 14 arranged on the downstream side of the carrying means 13. Therefore, the amount of slack of the recording medium RM to be supplied to each of the recording units 9 can be controlled properly.

According to the thermal printer 1 of the present embodiment, the carrying path, connecting the line thermal head 10 and the carrying roller 12 in a recording state of the second downstream recording unit 9 of a pair of adjacent recording units 9 is disposed at a position shifted from the extended direction of the carrying path connecting the line thermal head 10 and the carrying roller 12 in a recording state of the first upstream recording unit 9. Therefore, when the recording medium RM is supplied to the downstream recording unit 9, the recording medium RM can be reliably loosened (curved).

According to the thermal printer 1 of the present embodiment, the friction means 15 is formed to establish the carrying path into the downstream recording unit 9 of a pair of adjacent recording units 9. Therefore, when the recording medium RM is supplied to the downstream recording unit 9, the carrying path of the recording medium RM can be reliably and easily established.

According to the thermal printer 1 of the present embodiment, the following states can be switched over. One of the states is the fixed state where the friction roller 14 of the friction means 15 is restricted from rotating about the carrying roller 12 when the recording medium is introduced. The other is the free state where the friction roller 14 of the friction means 15 can rotate about the carrying roller 12 after the carrying path into the downstream recording unit 9 is formed. Therefore, with the friction roller 14 of the friction means 15 being in the fixed state, a predetermined carrying path can be easily obtained, which has the slack of the recording RM when the recording medium RM is introduced. With the friction roller 14 of the friction means 15 being in the free state, a speed difference in the carrying speed of the recording medium RM can be reduced by the rotation of the friction means 15 about the carrying roller 12, even though the speed difference is generated by the carrying means 13 of each of the recording units 9. In other words, in the respective recording units 9, an error in the amount of recording medium RM carried can be reduced to achieve the stabilized carrying state.

According to the thermal printer 1 of the present embodiment, the upper limit sensor 53 and the lower limit sensor 54 are provided as a determination sensor for determining whether the amount of slack of the recording medium RM is within an appropriate range or not. Therefore, it can be easily determined whether the amount of slack of the recording medium RM is adequate or not.

According to the thermal printer 1 of the present embodiment, in the case where it is determined by the upper limit sensor 53 and the lower limit sensor 54 that the amount of slack is not within an appropriate range, the control section 31 is provided to control the carrying speed of the recording medium RM by the carrying means 13 of the upstream recording unit 9 so that the amount of slack is within an appropriate range. Therefore, the amount of slack of the recording medium RM can be reliably controlled so as to be within an appropriate range at all times.

According to the thermal printer 1 of the present embodiment, the carrying means 13 has the carrying and pressing roller 34, which is opposite to the carrying roller 12 with the carrying path interposed therebetween and is brought into contact with and separated from the carrying roller 12, and is formed so that the recording medium RM can be interposed between the carrying roller 12 and the carrying and pressing roller 34 to be carried. Therefore, the recording medium RM can be carried more reliably.

According to the thermal head printer 1 of the present embodiment, the friction means 15 has the friction pressing roller 44, which is opposite to the friction roller 14 with the carrying path interposed therebetween and is brought into contact with and separated from the friction roller 14, and the recording medium RM is pressed by the friction roller 14 and the friction pressing roller 44 so that a friction load can be applied to the recording medium RM. Therefore, the disturbance generated in the downstream recording unit 9 can be reliably and easily prevented from propagating through the recording medium RM into the upstream recording unit 9, or specifically the carrying part and the recorded part of the recording unit 9. As a result, since positional deviation of the recorded position can be reliably prevented from occurring, high quality recording can be maintained.

According to the thermal printer 1 of the present embodiment, the interlocking means 57 is provided to interlock the following operations sequentially. They are a pressing operation of the carrying and pressing roller 34 against the carrying roller 12, a pressing operation of the friction pressing roller 44 against the friction roller 14, and a switching operation of switching the fixed state to a free state for the friction roller 14 of the friction means 15. Therefore, when the recording medium RM is carried and introduced, the formation of slack of the recording medium RM and the recording operation can be properly and reliably controlled.

The invention claimed is:

1. A thermal printer including a plurality of recording units arranged at predetermined intervals along a carrying path of a recording medium, each of the recording units comprising:

a thermal head;

a platen opposing the thermal head with the carrying path interposed therebetween and provided so as to be brought into contact with and separated from the thermal head;

a carrying roller arranged on a downstream side of the thermal head so as to carry the recording medium which passes through the thermal head toward the downstream side;

a carrying and pressing roller that can be pressed against the carrying roller;

a friction roller arranged on a downstream side of the carrying roller so as to prevent disturbances generated downstream between the respective recording units from propagating upstream via the recording medium; and a friction pressing roller which can be pressed against the friction roller.

2. The thermal printer according to claim 1, wherein the recording medium is pressed by the friction roller and the friction pressing roller so that a friction load can be applied to the recording medium.

3. The thermal printer according to claim 2 further comprising a friction-pressing-roller driving member supporting the friction pressing roller so that the friction pressing roller can be pressed against the friction roller.

4. The thermal printer according to claim 3, wherein the friction-pressing-roller driving member drives the friction pressing roller to be pressed against the friction roller when a leading end of the recording medium passes through a position where the friction roller opposes the friction pressing roller.

5. The thermal printer according to claim 4, wherein the friction roller is formed so as to switch a fixed state where the friction roller is restricted from rotating about the carrying roller when the recording medium is introduced, to a free state where the friction roller can rotate about the carrying roller after forming a carrying path into the downstream recording unit.

6. The thermal printer according to claim 5, further comprising an interlocking means that interlocks a pressing operation of the carrying and pressing roller against the carrying roller, a pressing operation of the friction pressing roller against the friction roller, and a switching operation of switching over from the fixed state to the free state for the friction roller, in the above-mentioned order.

7. The thermal printer according to claim 1, wherein the recording units, positioned adjacent to each other among the respective recording units, are arranged at shorter intervals than a length of a recording region per one sheet for an image to be recorded on the recording medium.

8. The thermal printer according to claim 1, wherein the carrying path, which connects the thermal head and the carrying roller, in a recording state, of the downstream recording unit of a pair of adjacent recording units is disposed at a position shifted from extended direction of the carrying path connecting the carrying roller and the thermal head of the upstream recording unit in a recording state is formed to establish the carrying path into the downstream recording unit of the pair of adjacent recording units, by the friction roller and the friction pressing roller.

9. The thermal printer according to claim 8 further comprising, a control section for controlling nip portions of the friction pressing roller and the friction roller, and a carrying roller so that the recording medium, which is positioned in the carrying path between the thermal head and the platen roller of the recording unit arranged right downstream of the nip portions, has slack.

10. The thermal printer according to claim 9, further comprising a determination sensor that determines whether an amount of slack of the recording medium is within an appropriate range or not.

11. The thermal printer according to claim 10, wherein, in the case where the determination sensor determines that the amount of slack is not within the appropriate range, the control section controls a carrying speed of the recording medium carried by the carrying roller of the upstream recording unit so that the amount of slack falls within the appropriate range.

* * * * *